US010780307B2

(12) United States Patent
Lagree et al.

(10) Patent No.: US 10,780,307 B2
(45) Date of Patent: Sep. 22, 2020

(54) ADJUSTABLE RESISTANCE EXERCISE MACHINE

(71) Applicant: Lagree Technologies, Inc., Burbank, CA (US)

(72) Inventors: Sebastien Anthony Louis Lagree, Burbank, CA (US); Samuel D. Cox, Yuba City, CA (US); Todd G. Remund, Yuba City, CA (US)

(73) Assignee: Lagree Technologies, Inc., Chatsworth, CA (US)

( * ) Notice: Subject to any disclaimer, the term of this patent is extended or adjusted under 35 U.S.C. 154(b) by 37 days.

(21) Appl. No.: 16/202,264

(22) Filed: Nov. 28, 2018

(65) Prior Publication Data

US 2019/0160320 A1 May 30, 2019

Related U.S. Application Data

(60) Provisional application No. 62/591,581, filed on Nov. 28, 2017.

(51) Int. Cl.
*A63B 21/045* (2006.01)
*A63B 23/035* (2006.01)
(Continued)

(52) U.S. Cl.
CPC .. *A63B 21/00069* (2013.01); *A63B 21/00065* (2013.01); *A63B 21/025* (2013.01);
(Continued)

(58) Field of Classification Search
CPC ..... A63B 21/00; A63B 21/0004; A63B 21/00047; A63B 21/00058;
(Continued)

(56) References Cited

U.S. PATENT DOCUMENTS 339,638 A 4/1886 Goldie
3,770,267 A 11/1973 McCarthy
(Continued)

FOREIGN PATENT DOCUMENTS

KR 1020070045511 5/2007
WO WO 2004/096376 11/2004
WO WO 2014/084742 6/2014

OTHER PUBLICATIONS http://www.brainproducts.com/productdetails.php?id=63&tab=1; LiveAmp Overview; Printed Jun. 14, 2016.
(Continued)

*Primary Examiner* — Loan B Jimenez
*Assistant Examiner* — Zachary T Moore
(74) *Attorney, Agent, or Firm* — Neustel Law Offices

(57) ABSTRACT

An adjustable resistance exercise machine for providing variable resistance forces on a pull cable extending from the machine. The adjustable resistance exercise machine generally includes a plurality of power springs that may be selectively engaged using a cam mechanism. By engaging springs with different forces, the resistance may be adjusted incrementally as preferred for performing different exercises. The adjustable resistance exercise machine may be connected to various structures, either below or above an exerciser, to allow the exerciser to choose whether to pull the pull cable up or down during exercise.

20 Claims, 16 Drawing Sheets

(51) Int. Cl.

| | |
|---|---|
| ***A63B 23/12*** | (2006.01) |
| ***A63B 21/22*** | (2006.01) |
| ***A63B 21/02*** | (2006.01) |
| ***A63B 21/16*** | (2006.01) |
| ***A63B 21/00*** | (2006.01) |

(52) U.S. Cl.

CPC ..... *A63B 21/045* (2013.01); *A63B 21/0455* (2013.01); *A63B 21/153* (2013.01); *A63B 21/155* (2013.01); *A63B 21/22* (2013.01); *A63B 21/4043* (2015.10); *A63B 23/03525* (2013.01); *A63B 23/12* (2013.01); *A63B 21/169* (2015.10); *A63B 21/1618* (2013.01); *A63B 2225/093* (2013.01)

(58) Field of Classification Search

CPC ..... A63B 21/00061; A63B 21/00065; A63B 21/00069; A63B 21/00178; A63B 21/00185; A63B 21/02; A63B 21/022; A63B 21/023; A63B 21/025; A63B 21/026; A63B 21/04; A63B 21/0407; A63B 21/0442; A63B 21/045; A63B 21/057; A63B 21/0552; A63B 21/0555; A63B 21/005; A63B 21/151; A63B 21/153; A63B 21/154; A63B 21/157; A63B 21/159; A63B 21/16; A63B 21/1609; A63B 21/1618; A63B 21/1681; A63B 21/169; A63B 21/22; A63B 21/40; A63B 21/4041; A63B 21/4043; A63B 21/4045; A63B 21/4047; A63B 21/4049; A63B 22/00; A63B 22/0076; A63B 23/00; A63B 23/02; A63B 23/0205; A63B 23/0233; A63B 23/0244; A63B 23/035; A63B 23/03508; A63B 23/03516; A63B 23/0355; A63B 23/12; A63B 23/1209; A63B 23/1245; A63B 23/1281; A63B 23/14; B65H 75/4431; B65H 75/4428; B65H 75/4434

See application file for complete search history.

(56) References Cited

U.S. PATENT DOCUMENTS

| | | | | |
|---|---|---|---|---|
| 3,806,094 | A | 4/1974 | Harken | |
| 3,995,853 | A * | 12/1976 | Deluty | A63B 21/015 482/116 |
| 4,013,068 | A | 3/1977 | Settle | |
| 4,202,510 | A | 5/1980 | Stanish | |
| 4,501,230 | A | 2/1985 | Talo | |
| 4,591,151 | A | 5/1986 | Hensley | |
| 4,759,540 | A | 7/1988 | Yu | |
| 4,798,378 | A | 1/1989 | Jones | |
| 4,805,901 | A | 2/1989 | Kulick | |
| 4,838,547 | A | 6/1989 | Sterling | |
| 4,933,657 | A | 6/1990 | Bessho | |
| 5,066,005 | A | 11/1991 | Luecke | |
| 5,176,601 | A | 1/1993 | Reynolds | |
| 5,201,694 | A | 4/1993 | Zappel | |
| 5,263,913 | A | 11/1993 | Boren | |
| 5,269,512 | A | 12/1993 | Crowson | |
| 5,316,535 | A | 5/1994 | Bradbury | |
| 5,360,382 | A | 11/1994 | Chi | |
| 5,365,934 | A | 11/1994 | Leon | |
| 5,505,681 | A * | 4/1996 | Bruggemann | A63B 21/153 482/127 |
| 5,669,865 | A | 9/1997 | Gordon | |
| 5,718,659 | A | 2/1998 | Van Straaten | |
| 5,733,231 | A | 3/1998 | Corn | |
| 5,738,104 | A | 4/1998 | Lo | |
| 5,812,978 | A | 9/1998 | Nolan | |
| 5,885,197 | A | 3/1999 | Barton | |
| 5,899,836 | A | 5/1999 | Chen | |
| 5,906,566 | A | 5/1999 | Whitcomb | |
| 5,944,641 | A | 8/1999 | Habing | |
| 5,967,955 | A | 10/1999 | Westfall | |
| 5,997,442 | A | 12/1999 | Cordes | |
| 6,152,856 | A | 11/2000 | Studor | |
| 6,152,866 | A | 11/2000 | Kuo | |
| 6,179,753 | B1 | 1/2001 | Barker | |
| 6,264,586 | B1 | 7/2001 | Webber | |
| 6,440,044 | B1 * | 8/2002 | Francis | A63B 21/0455 482/114 |
| 6,761,670 | B2 * | 7/2004 | Liou | A63B 21/153 482/57 |
| 6,790,163 | B1 | 9/2004 | Van De Laarschot | |
| 6,929,589 | B1 * | 8/2005 | Bruggemann | A63B 21/025 482/121 |
| 7,108,635 | B2 | 9/2006 | Howlett-Campanella | |
| 7,128,700 | B2 | 10/2006 | Wallach | |
| 7,137,936 | B1 * | 11/2006 | Shaw | A63B 21/025 482/127 |
| 7,163,500 | B2 | 1/2007 | Endelman | |
| 7,192,387 | B2 | 3/2007 | Mendel | |
| 7,195,584 | B1 | 3/2007 | Lu | |
| 7,226,401 | B2 | 6/2007 | Van Straaten | |
| 7,261,676 | B2 | 8/2007 | Liou | |
| 7,294,096 | B1 | 11/2007 | Stearns | |
| 7,448,986 | B1 | 11/2008 | Porth | |
| 7,537,554 | B2 | 5/2009 | Zhuang | |
| 7,803,095 | B1 | 9/2010 | Lagree | |
| 7,871,359 | B2 * | 1/2011 | Humble | A63B 21/153 242/375.1 |
| 7,878,955 | B1 | 2/2011 | Ehrlich | |
| 7,914,420 | B2 | 3/2011 | Daly | |
| 7,967,728 | B2 | 6/2011 | Zavadsky | |
| 8,287,434 | B2 | 10/2012 | Zavadsky | |
| 8,303,470 | B2 | 11/2012 | Stewart | |
| 8,328,700 | B2 | 12/2012 | Humble | |
| 8,641,585 | B2 | 2/2014 | Lagree | |
| 8,812,075 | B2 | 8/2014 | Nguyen | |
| 8,852,062 | B2 | 10/2014 | Dorsay | |
| 8,911,328 | B2 | 12/2014 | Alessandri | |
| 9,011,291 | B2 | 4/2015 | Birrell | |
| 9,199,123 | B2 | 12/2015 | Solow | |
| 2001/0056011 | A1 | 12/2001 | Endelman | |
| 2002/0025888 | A1 | 2/2002 | Germanton | |
| 2002/0025891 | A1 * | 2/2002 | Colosky, Jr. | A63B 21/0455 482/127 |
| 2002/0137607 | A1 | 9/2002 | Endelman | |
| 2003/0050153 | A1 * | 3/2003 | Stevens | A63B 21/0618 482/92 |
| 2003/0119635 | A1 | 6/2003 | Arbuckle | |
| 2004/0043873 | A1 | 3/2004 | Wilkinson | |
| 2004/0180761 | A1 | 9/2004 | Liou | |
| 2005/0085351 | A1 | 4/2005 | Kissel | |
| 2005/0101447 | A9 | 5/2005 | Pyles | |
| 2006/0046914 | A1 | 3/2006 | Endelman | |
| 2006/0105889 | A1 | 5/2006 | Webb | |
| 2006/0183606 | A1 | 8/2006 | Parmater | |
| 2006/0199712 | A1 | 9/2006 | Barnard | |
| 2007/0202992 | A1 | 8/2007 | Grasshoff | |
| 2007/0224582 | A1 | 9/2007 | Hayashino | |
| 2007/0270293 | A1 | 11/2007 | Zhuang | |
| 2008/0051256 | A1 | 2/2008 | Ashby | |
| 2008/0058174 | A1 | 3/2008 | Barnard | |
| 2008/0070765 | A1 | 3/2008 | Brown | |
| 2008/0139975 | A1 | 6/2008 | Einav | |
| 2008/0242519 | A1 | 10/2008 | Parmater | |
| 2008/0248935 | A1 | 10/2008 | Solow | |
| 2008/0254952 | A1 | 10/2008 | Webb | |
| 2008/0280734 | A1 | 11/2008 | Dickie | |
| 2009/0005698 | A1 | 1/2009 | Lin | |
| 2009/0023561 | A1 | 1/2009 | Ross | |
| 2009/0291805 | A1 | 11/2009 | Blum | |
| 2009/0312152 | A1 | 12/2009 | Kord | |
| 2010/0125026 | A1 | 5/2010 | Zavadsky | |
| 2010/0144499 | A1 | 6/2010 | Graham | |
| 2010/0227748 | A1 | 9/2010 | Campanaro | |
| 2010/0267524 | A1 | 10/2010 | Stewart | |

(56) References Cited

U.S. PATENT DOCUMENTS

| | | | |
|---|---|---|---|
| 2011/0018233 | A1 | 1/2011 | Senner |
| 2011/0039665 | A1 | 2/2011 | Dibble |
| 2011/0077127 | A1 | 3/2011 | Ishii |
| 2011/0152045 | A1 | 6/2011 | Horne |
| 2011/0166002 | A1 | 7/2011 | Savsek |
| 2011/0172069 | A1 | 7/2011 | Gerschefske |
| 2011/0184559 | A1 | 7/2011 | Benabid |
| 2012/0015334 | A1 | 1/2012 | Hamilton |
| 2012/0088634 | A1 | 4/2012 | Heidecke |
| 2012/0143020 | A1 | 6/2012 | Bordoley |
| 2012/0190505 | A1 | 7/2012 | Shavit |
| 2012/0202656 | A1 | 8/2012 | Dorsay |
| 2012/0228385 | A1 | 9/2012 | DeLuca |
| 2012/0295771 | A1 | 11/2012 | Lagree |
| 2013/0072353 | A1 | 3/2013 | Alessandri |
| 2013/0150216 | A1 | 6/2013 | Bell |
| 2013/0196835 | A1 | 8/2013 | Solow |
| 2013/0210578 | A1 | 8/2013 | Birrell |
| 2013/0289889 | A1 | 10/2013 | Yuen |
| 2014/0011645 | A1 | 1/2014 | Johnson |
| 2014/0066257 | A1 | 3/2014 | Shavit |
| 2014/0100089 | A1 | 4/2014 | Kermath |
| 2014/0121076 | A1 | 5/2014 | Lagree |
| 2014/0121078 | A1 | 5/2014 | Lagree |
| 2014/0121079 | A1 | 5/2014 | Lagree |
| 2014/0141948 | A1 | 5/2014 | Aronson |
| 2014/0148715 | A1 | 5/2014 | Alexander |
| 2014/0213415 | A1 | 7/2014 | Parker |
| 2015/0012111 | A1 | 1/2015 | Contreras-Vidal |
| 2015/0024914 | A1 | 1/2015 | Lagree |
| 2015/0057127 | A1 | 2/2015 | Lagree |
| 2015/0065318 | A1 | 3/2015 | Lagree |
| 2015/0072841 | A1 | 3/2015 | Lagree |
| 2015/0105223 | A1 | 4/2015 | Bissu |
| 2015/0141204 | A1 | 5/2015 | Lagree |
| 2015/0217164 | A1 | 8/2015 | Lagree |
| 2015/0220523 | A1 | 8/2015 | Lagree |
| 2015/0246263 | A1 | 9/2015 | Campanaro |
| 2015/0297944 | A1 | 10/2015 | Lagree |
| 2015/0329011 | A1 | 11/2015 | Kawai |
| 2015/0343250 | A1 | 12/2015 | Lagree |
| 2015/0360068 | A1 | 12/2015 | Lagree |
| 2015/0360083 | A1 | 12/2015 | Lagree |
| 2015/0360113 | A1 | 12/2015 | Lagree |
| 2015/0364058 | A1 | 12/2015 | Lagree |
| 2015/0364059 | A1 | 12/2015 | Marks |
| 2015/0367166 | A1 | 12/2015 | Lagree |
| 2016/0008657 | A1 | 1/2016 | Lagree |
| 2016/0059060 | A1 | 3/2016 | Lagree |
| 2016/0059061 | A1 | 3/2016 | Lagree |
| 2016/0074691 | A1 | 3/2016 | Pearce |
| 2016/0096059 | A1 | 4/2016 | Lagree |
| 2016/0166870 | A1 | 6/2016 | Lagree |
| 2016/0193496 | A1 | 7/2016 | Lagree |
| 2016/0256733 | A1 | 9/2016 | Lagree |
| 2016/0271452 | A1 | 9/2016 | Lagree |
| 2016/0317858 | A1 | 11/2016 | Lagree |
| 2016/0346593 | A1 | 12/2016 | Lagree |
| 2016/0361602 | A1 | 12/2016 | Lagree |
| 2017/0014664 | A1 | 1/2017 | Lagree |
| 2017/0014672 | A1 | 1/2017 | Lagree |
| 2017/0036057 | A1 | 2/2017 | Lagree |
| 2017/0036061 | A1 | 2/2017 | Lagree |
| 2017/0065846 | A1 | 3/2017 | Lagree |
| 2017/0072252 | A1 | 3/2017 | Lagree |
| 2017/0087397 | A1 | 3/2017 | Lagree |
| 2017/0100625 | A1 | 4/2017 | Lagree |
| 2017/0100629 | A1 | 4/2017 | Lagree |
| 2017/0106232 | A1 | 4/2017 | Lagree |
| 2017/0113091 | A1 | 4/2017 | Lagree |
| 2017/0120101 | A1 | 5/2017 | Lagree |
| 2017/0144013 | A1 | 5/2017 | Lagree |
| 2017/0157452 | A1 | 6/2017 | Lagree |
| 2017/0157458 | A1 | 6/2017 | Lagree |
| 2017/0165518 | A1 | 6/2017 | Lagree |
| 2017/0165555 | A1 | 6/2017 | Lagree |
| 2017/0189740 | A1 | 7/2017 | Lagree |
| 2017/0189741 | A1 | 7/2017 | Lagree |
| 2017/0209728 | A1 | 7/2017 | Lagree |
| 2017/0239526 | A1 | 8/2017 | Lagree |
| 2017/0246491 | A1 | 8/2017 | Lagree |
| 2017/0246499 | A1 | 8/2017 | Lagree |
| 2017/0296865 | A1 | 10/2017 | Lagree |
| 2017/0304673 | A1 | 10/2017 | Lagree |
| 2017/0326406 | A1 | 11/2017 | Lagree |
| 2017/0340947 | A1 | 11/2017 | Lagree |
| 2017/0354840 | A1 | 12/2017 | Lagree |
| 2018/0015319 | A1 | 1/2018 | Lagree |
| 2018/0021621 | A1 | 1/2018 | Lagree |
| 2018/0021655 | A1 | 1/2018 | Lagree |
| 2018/0036583 | A1 | 2/2018 | Lagree |
| 2018/0056109 | A1 | 3/2018 | Lagree |
| 2018/0056133 | A1 | 3/2018 | Lagree |
| 2018/0111020 | A1 | 4/2018 | Lagree |
| 2018/0111033 | A1 | 4/2018 | Lagree |
| 2018/0117392 | A1 | 5/2018 | Lagree |
| 2018/0133532 | A1 | 5/2018 | Lagree |
| 2018/0133533 | A1 | 5/2018 | Lagree |
| 2018/0133534 | A1 | 5/2018 | Lagree |
| 2018/0133542 | A1 | 5/2018 | Lagree |
| 2018/0178053 | A1 | 6/2018 | Lagree |
| 2018/0193691 | A1 | 7/2018 | Lagree |
| 2018/0214731 | A1* | 8/2018 | Sherin ..... A63B 21/025 |
| 2018/0250551 | A1 | 9/2018 | Lagree |
| 2018/0250573 | A1 | 9/2018 | Lagree |
| 2018/0272179 | A1 | 9/2018 | Lagree |
| 2018/0280782 | A1 | 10/2018 | Lagree |
| 2018/0318627 | A1* | 11/2018 | Lagree ..... A63B 21/023 |
| 2018/0318646 | A1 | 11/2018 | Lagree |
| 2018/0326252 | A1 | 11/2018 | Lagree |
| 2018/0353803 | A1 | 12/2018 | Lagree |
| 2018/0361190 | A1 | 12/2018 | Lagree |
| 2018/0361197 | A1 | 12/2018 | Lagree |
| 2019/0001175 | A1* | 1/2019 | Wagner ..... A63B 21/16 |
| 2019/0083842 | A1 | 3/2019 | Lagree |

OTHER PUBLICATIONS http://www.cognionics.com/index.php/products/hd-eeg-systems/72-channel-system; Cognionics HD-72 Overview; Printed Jun. 14, 2016.

http://www.cognionics.com/index.php/products/hd-eeg-systems/quick-20-dry-heads et; Cognionics Quick-20 Dry EEG Headset; Printed Jun. 14, 2016.

http://www.cognionics.com/index.php/products/mini-systems/multi-position-dry-headband; Cognionics Multi-Position Dry EEG Headband; Printed Jun. 14, 2016.

http://www.cognionics.com/index.php/products/mini-systems/dry-eeg-headband; Cognionics Dry EEG Headband; Printed Jun. 14, 2016.

http://www.cognionics.com/index.php/products/hd-eeg-systems/mobile-eeg-cap; Cognionics Mobile-72 Wireless EEG System; Printed Jun. 14, 2016.

PCT International Search and Opinion for PCTUS2017041638.

PCT Preliminary Report on Patentability from International Searching Authority for PCTUS2016022888.

PCT International Search and Opinion for PCTUS2016022888.

http://tera.lunar-europe.com; TERA Fitness Mat; Lunar Europe; Jun. 8, 2014.

http://www.puzzlebox.io/brainstorms/; Puzzlebox Brainstorms Website Article; Jun. 13, 2016.

https://www.youtube.com/watch?v=xj2xuGsB3yo; Screenshot of YouTube Video "Iphone free App (Dec. 16, 2010) Finger Balance"; tuuske; Dec. 16, 2010.

PCT International Search Report and Written Opinion for PCT/US15/47746.

* cited by examiner

400

401

| FIGURE NUMBER | LEFT A | LEFT B | RIGHT B | RIGHT A | TOT PULL WT. "R" |
|---|---|---|---|---|---|
| | CLOCK SPRING RATED WEIGHT | | | | |
| | 10 LB | 5 LB | 7 LB | 14 LB | |
| 14B | | 5 | | | 5 |
| 14C | | | 7 | | 7 |
| 14D | | 5 | 7 | | 12 |
| 14E | 10 | 5 | | | 15 |
| 14F | | | 7 | 14 | 21 |
| 14G | 10 | 5 | 7 | | 22 |
| 14H | | 5 | 7 | 14 | 26 |
| 14J | 10 | 5 | 5 | 14 | 36 |

ADJUSTABLE RESISTANCE EXERCISE MACHINE

CROSS REFERENCE TO RELATED APPLICATIONS

I hereby claim benefit under Title 35, United States Code, Section 119(*e*) of U.S. provisional patent application Ser. No. 62/591,581 filed Nov. 28, 2017. The 62/591,581 application is currently pending. The 62/591,581 application is hereby incorporated by reference into this application.

STATEMENT REGARDING FEDERALLY SPONSORED RESEARCH OR DEVELOPMENT

Not applicable to this application.

BACKGROUND

Resistance based exercise machines have been commercially available for many decades, and are well known to those in the fitness industry.

Exercise machines often use weighted steel plates to provide the resistance force which require a heavy structure to which the cables, handles, and supports are attached. Often, the heavy structure is literally heavier than the total movable weight. As one example, a resistance machine with 100 pounds of movable weight may weigh 200 pounds after including all of the structure and attachments. Therefore, machines that rely on gravity and steel weighted plates have a disadvantage of not being easily transportable.

Elastic bands and springs have been used as replacements for weighted plates. Both elastic bands and springs may provide a resistance force that typically exceeds their gross weight, and both may provide for easier transportability. For example, a set of elastic bands that weigh only three or four pounds may provide a resistance force of twenty pounds or more during the process of extending the length of the elastic bands or springs.

Those skilled in the art will appreciate that spring force is variable, increasing at a rate relative to the distance that a spring is extended or compressed, a principle of physics known as Hooke's Law.

Power springs, also referred to as clock springs, are spiral torsion springs that produce torque about a center arbor. The natural tendency of a power spring is to lengthen, or unwind the coils. Therefore, a variable resistance force is created when a power spring is forced to shorten, or to be wound more tightly around a central arbor. The amount of the resistance force, or torque, increases as the number of windings increase when the spring is wound tighter, and decreases as the spring unwinds.

Power springs are oftentimes used to retract a length of material that has been played out from a winding, for instance, to retract a lawn mower starter pull cord after starting the mower, or to retract a length of metal tape that has been pulled from a contractors tape measure after measuring a length. The power spring torque in both instances just described is intended to be no greater than the minimum force required for cord or tape measure retraction.

On the other hand, higher torque power springs may be used to provide a heavy dead weight equivalent for resistance based exercising.

The variable resistance of a spring during exercise is often preferred to the linear resistance of a dead weight since extended arms or legs of an exerciser have lower weight bearing potential than flexed limbs. The lower resistance of a power spring at the beginning of an exercise reduces soft tissue and joint injury when compared to starting an exercise with substantially higher resistance springs. As the spring deformation increases during an exercise, the limbs of the exerciser are typically in a mechanically advantageous position, capable of producing substantially more work without joint or soft tissue injury.

One problem is that power spring based exercise machines do not provide a user with the ability to change the amount of torque as may be preferred by an exerciser. Further, the extension and retraction of a pull cord of a machine with a single power spring is not smooth and continuous. Friction increases between the spiraled windings as the number of windings increases, causing the extension and retraction of the pull cable to be intermittently rough and discontinuous.

Those skilled in the art will appreciate the novelty and commercial value of a transportable, smoothly operating power spring based resistance training machine that further provides the exerciser with the ability to engage a preferred number of a plurality of power springs of various torque ratings to produce the desired exercise resistance.

SUMMARY

An example embodiment is directed to an adjustable resistance exercise machine. The adjustable resistance exercise machine is novel, easily transportable, and incorporates a plurality of power springs adapted to create variable resistance forces on a pull cable extending from the adjustable resistance exercise machine. Various embodiments provide an exerciser with the ability to adjust the number of power springs to engage, thereby adjusting the total resistance force on the pull cable as may be preferred for performing different exercises. The adjustable resistance exercise machine may be connected to various structures, either below or above an exerciser, to allow the exerciser to choose whether to pull the pull cable upwardly or downwardly during exercise.

There has thus been outlined, rather broadly, some of the embodiments of the adjustable resistance exercise machine in order that the detailed description thereof may be better understood, and in order that the present contribution to the art may be better appreciated. There are additional embodiments of the adjustable resistance exercise machine that will be described hereinafter and that will form the subject matter of the claims appended hereto. In this respect, before explaining at least one embodiment of the adjustable resistance exercise machine in detail, it is to be understood that the adjustable resistance exercise machine is not limited in its application to the details of construction or to the arrangements of the components set forth in the following description or illustrated in the drawings. The adjustable resistance exercise machine is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Example embodiments will become more fully understood from the detailed description given herein below and the accompanying drawings, wherein like elements are represented by like reference characters, which are given by way of illustration only and thus are not limitative of the example embodiments herein.

DETAILED DESCRIPTION

Various aspects of specific embodiments are disclosed in the following description and related drawings. Alternate embodiments may be devised without departing from the spirit or the scope of the present disclosure. Additionally, well-known elements of exemplary embodiments will not be described in detail or will be omitted so as not to obscure relevant details. Further, to facilitate an understanding of the description, a discussion of several terms used herein follows.

The word "exemplary" is used herein to mean "serving as an example, instance, or illustration." Any embodiment described herein as "exemplary" is not necessarily to be construed as preferred or advantageous over other embodiments.

The word "machine" is used herein to mean "a portable power spring based resistance exercise device", and may be used interchangeably with "exercise machine" or "exercise device" with no difference in meaning.

Further, the descriptive phrase "variable resistance" is used to describe an exercise machine in which the resistance is determined by one or more power springs as installed during manufacturing but which cannot be disengaged from a pull cord, and the descriptive phrase "adjustable resistance" is used to describe an exercise machine with a plurality of power springs that may be engaged or disengaged by an exerciser to adjust the total force produced by the machine for resistance exercising. It should be noted that the descriptive phrases are used merely to differentiate between two variations of resistance exercise machines, understanding that both the "variable resistance" and "adjustable resistance" exercise machines incorporate power springs that produce a variable resistance as the number of windings are increased or decreased in response to a pull cable being extracted from or retracted into the machine during exercise.

Figures 1, 2:
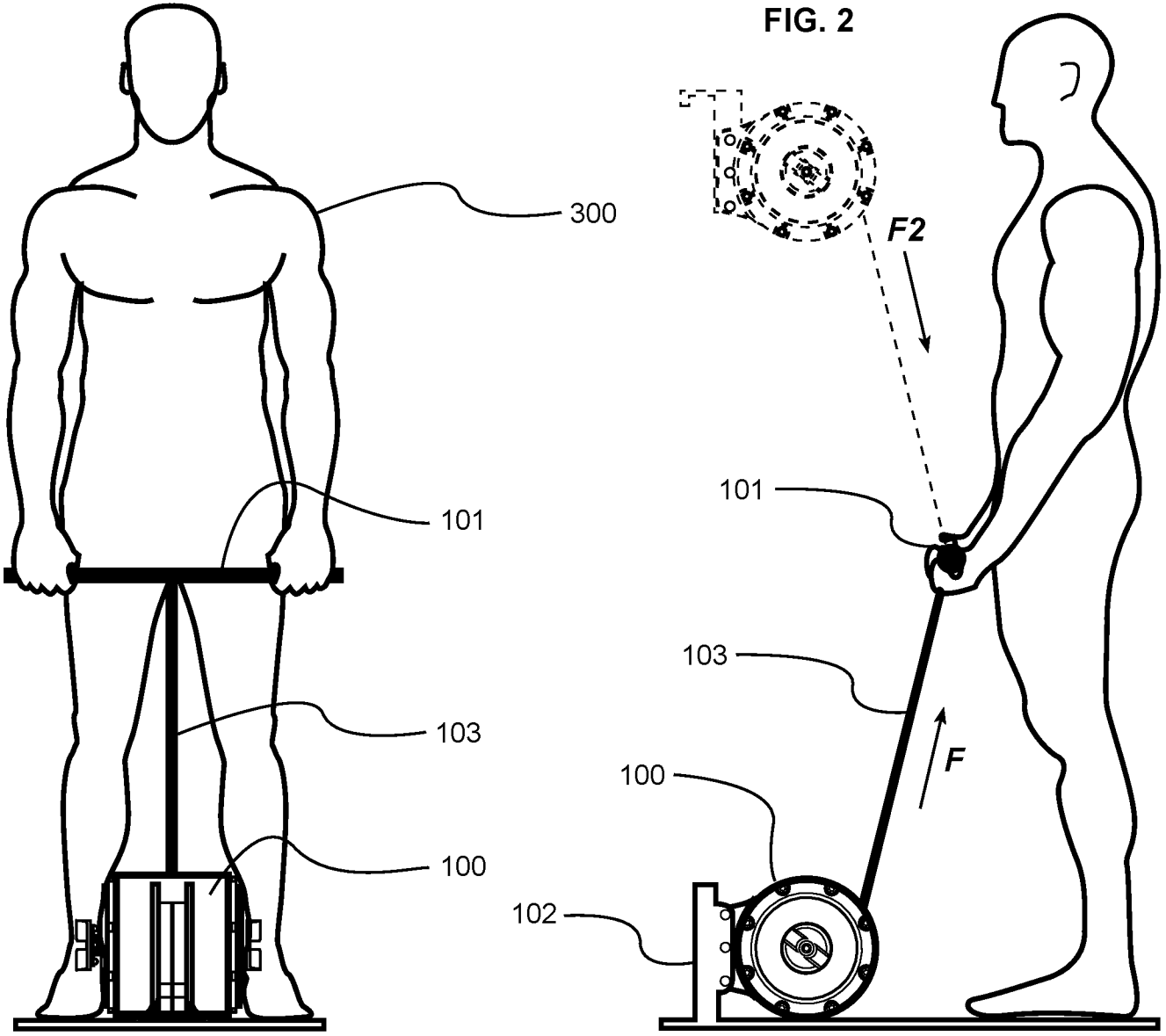
FIG. 1 is an exemplary illustration showing a front view of an exerciser using an exercise machine.
FIG. 2 is an exemplary illustration showing a side view of an exerciser using an exercise machine.

FIG. 1 is an exemplary illustration showing a front view of an exerciser using an exercise machine 100. FIG. 1 illustrates an exerciser 300 standing on a platform with the hands grasping a pull handle 101 affixed to a first end of a pull cable 103. The second end of the pull cable 103 is wound about and connected to a pulley 134. Various types of pulleys known in the art may be utilized, and thus the scope should not be construed as limited to any particular type of pulley device. The pull cable 103 may be internally positioned within the adjustable resistance exercise machine 100; with the exercise machine 100 being affixed to a support member 102 and platform that secures the exercise machine 100 in a fixed position during exercise.

It should be noted that the adjustable resistance exercise machine 100 may be removably attached to a securing member 102 such as a typical door, door frame, wall, or to any other stationary structure or large item. The manner in which the exercise machine 100 is so removably attached may vary in different embodiments, including the use of specialized accessories not shown, but which may be affixed to the machine 100 for use by an exerciser 300.

FIG. 2 is an exemplary illustration showing a side view of an exerciser 300 using an exercise machine 100. In the drawing, an exerciser 300 is shown standing on a platform with the hands grasping a pull handle 101 affixed to a first end of a pull cable 103. The second end of the pull cable may be attached to an adjustable resistance exercise machine 100 that is affixed to a support member 102 that secures the exercise machine in a stationary position for exercising. The exerciser pulls the handle 101, and concurrently the pull cable 103, in an upward direction with a force F that exceeds the resistance created by a plurality of power springs 115 which are contained within the exercise machine.

On the other hand, it is sometimes preferable to perform exercises by pulling against a resistance in a downward direction as a means to exercise different muscles and muscle groups compared to pulling against a resistance in an upward direction. As one variation to securing the exercise machine 100 proximal to the floor, a dotted outline of an exercise machine 100 and pull cable 103 in FIG. 2 illustrates an alternate position of the machine 100 allowing for pull down exercises, for example, affixing the machine 100 to the top of a typical door. When the exercise machine 100 is positioned as just described, the exerciser 300 shown would pull the handle 101 downwardly against the exercise machine 100 resistance with a force F2 sufficient to overcome the resistance created by the power springs 115 of the exercise machine 100.

Therefore, it should be noted that the temporary stationary positioning of the machine 100 is not meant to be limited, and that positioning of the machine 100 above, below, in front of, behind, or adjacent to the exerciser 300 may be preferred by an exerciser 300 to exercise different muscles and/or muscle groups that require the occasional repositioning of the machine 100.

Figure 3:
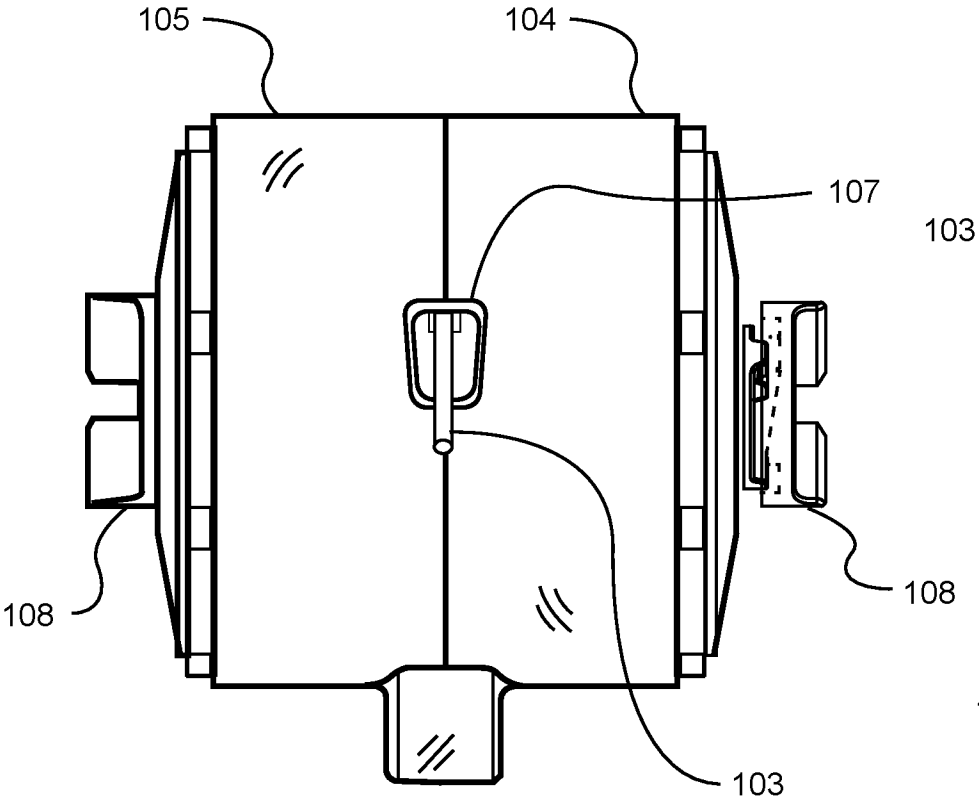
FIG. 3 is an exemplary illustration showing a front view of an adjustable resistance exercise machine.

FIG. 3 is an exemplary illustration showing a front view of an adjustable resistance exercise machine 100 comprised of a right outer case 104, a left outer case 105, and a pull cable 103 protruding from the machine interior through a cable port 107. A plurality of cam knobs 108 are shown aligned with the center of the transverse axis of the machine 100 and positioned substantially at the opposed ends of a transverse shaft which will be fully described herein. The cam knobs 108 provide for the engagement and/or disengagement of one or more power springs 115 to produce a preferred resistance force for exercising.

Figure 4:
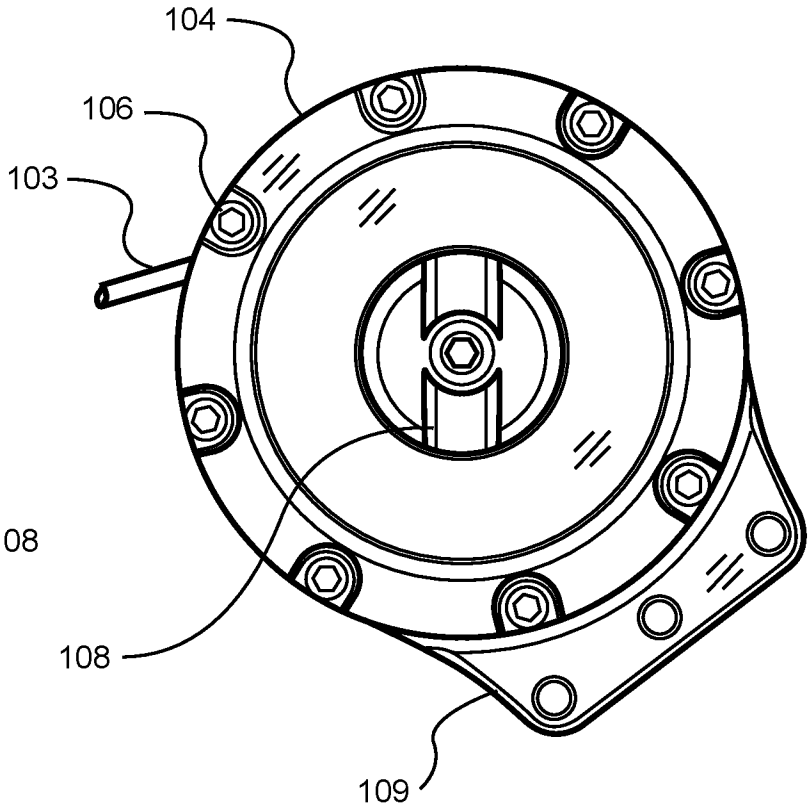
FIG. 4 is an exemplary illustration showing a first side view of an adjustable resistance exercise machine.

FIG. 4 is an exemplary illustration showing a side view of an adjustable resistance exercise machine 100. A plurality of bolts 106 secure the right outer case 104 to the left outer case 105 previously described. Various other types of fasteners may be utilized in different embodiments to secure the outer cases 104, 105 together.

A portion of a pull cable 103 is shown protruding from the interior of the machine 100. A cam knob 108 may be rotated clockwise or counterclockwise by an exerciser to increase or decrease the number of power springs 115 engaged to produce a resistance force as may be preferred by an exerciser 300 for performing various resistance training exercises.

A mounting block 109, which may be integral with the outer cases 104, 105 or interconnected with the outer cases 104, 105, provides for the attachment of the machine 100 to a stationary structure such as a support member 102 for exercising, and further provides for the attachment of various brackets and related components which allow the machine 100 to be temporarily secured to various stationary objects such as a support member 102 for exercising. For example, the machine 100 may be hung on the upper edge of a door for pull down exercises, or secured proximate to the floor for pull up exercises by hooking a bracket under the lower edge of a typical door.

Those skilled in the art will appreciate that a nearly unlimited number of brackets, clamps and other purpose-designed accessories may be produced and attached to the mounting block 109 to easily removably secure the machine to a stationary object for exercising. The types and configuration of the various accessories are not meant to be limited, and any add on accessory that secures the machine to a stationary object may be used without departing from the scope of the present invention.

The shape, size, and structure of the mounting block 109 may vary in different embodiments. The figures illustrate that the mounting block 109 extends outwardly from both the right outer case 104 and the left outer case 105 in a manner in which two halves of the mounting block 109 may be engaged with each other when the outer cases 104, 105 are interconnected. The mounting block 109 may include openings as shown in the figures to receive fasteners or the like.

Figure 5:
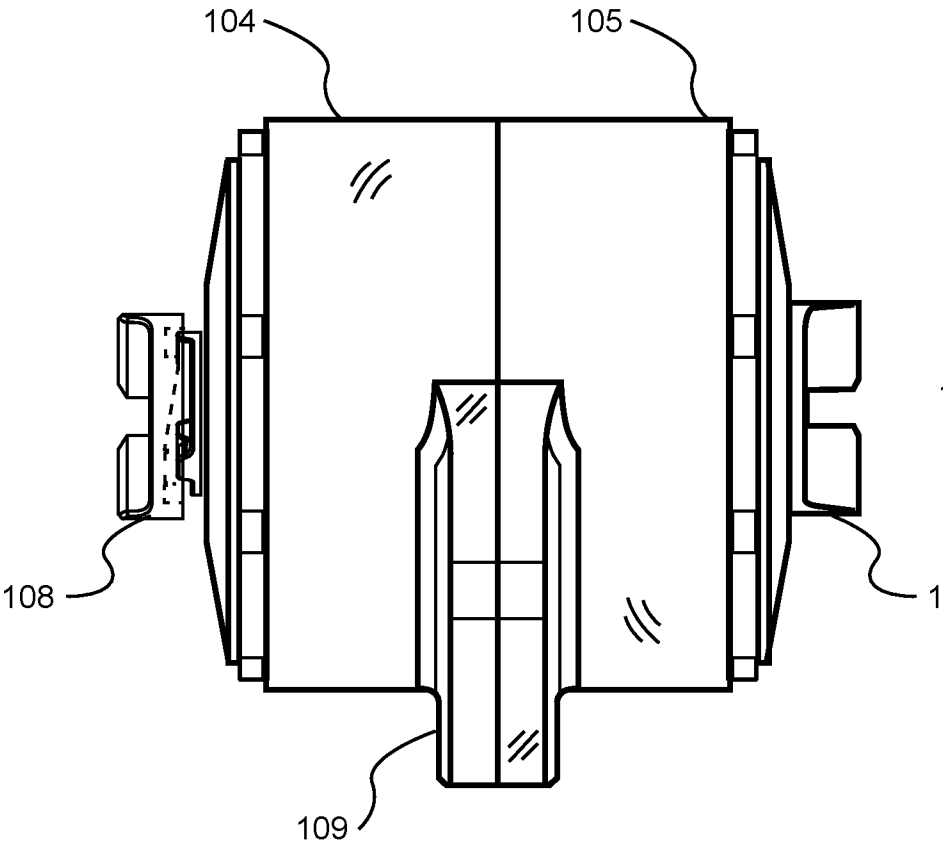
FIG. 5 is an exemplary illustration showing a back view of an adjustable resistance exercise machine.

FIG. 5 is an exemplary illustration showing a back view of an adjustable resistance exercise machine comprised of a right outer case 104, a left outer case 105, and a mounting block 109 used to secure the machine to a stationary object for exercising. A plurality of cam knobs 108 are shown aligned with the center of the transverse axis of, and positioned at the opposed sides of the machine 100. The cam knobs 108 provide for adjusting the total machine resistance force for exercising.

Figure 6:
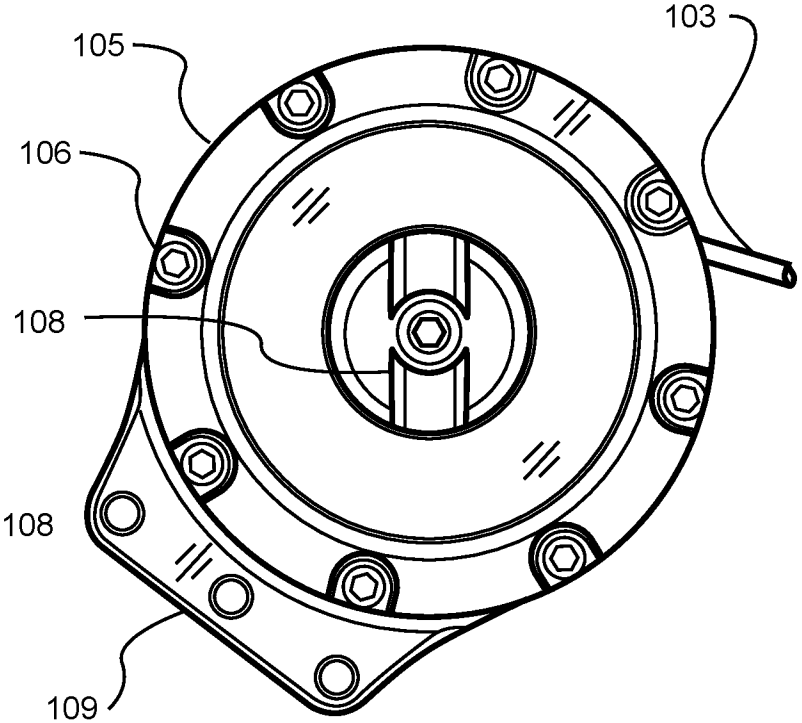
FIG. 6 is an exemplary illustration showing a second side view of an adjustable resistance exercise machine.

FIG. 6 is an exemplary illustration showing an opposed side view of an adjustable resistance exercise machine 100. A plurality of bolts 106 secure the left outer case 105 with the right outer case 104. A portion of a pull cable 103 is shown protruding from the interior of the machine 100. A cam knob 108 may be rotated clockwise or counterclockwise by an exerciser to increase or decrease the number of power springs 115 engaged to produce a resistance force, and the mounting block 109 shown in the drawing is used to secure the machine to a stationary object for exercising.

Figure 7:
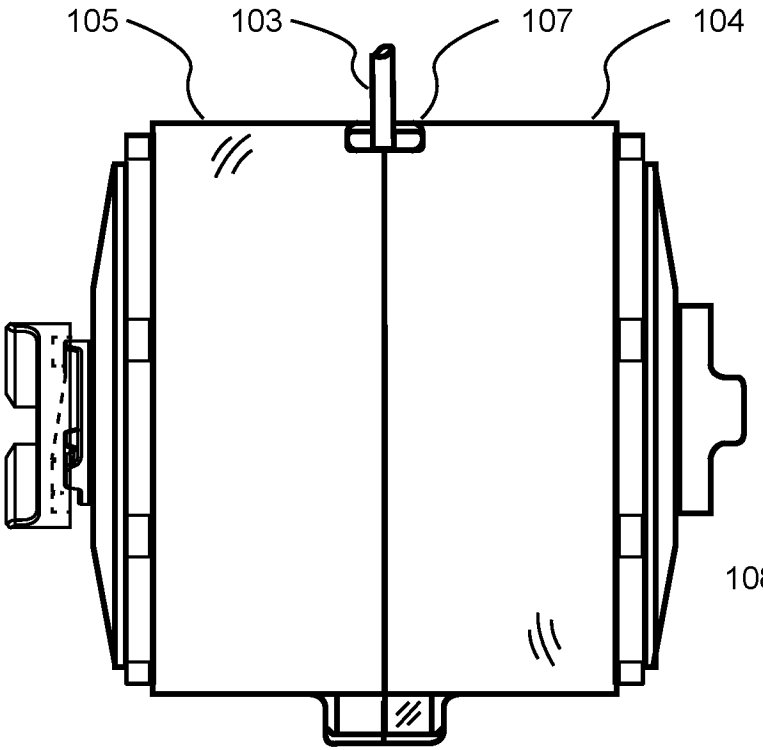
FIG. 7 is an exemplary illustration showing a top view of an adjustable resistance exercise machine.

FIG. 7 is an exemplary illustration showing a top view of an adjustable resistance exercise machine 100 comprising a right outer case 104, a left outer case 105, and a pull cable

103 protruding from the machine interior through a cable port 107. A plurality of cam knobs 108 are shown aligned with the center of the transverse axis of the machine; the cam knobs 108 providing for the adjustment of the machine resistance for exercising as previously described.

Figure 8:
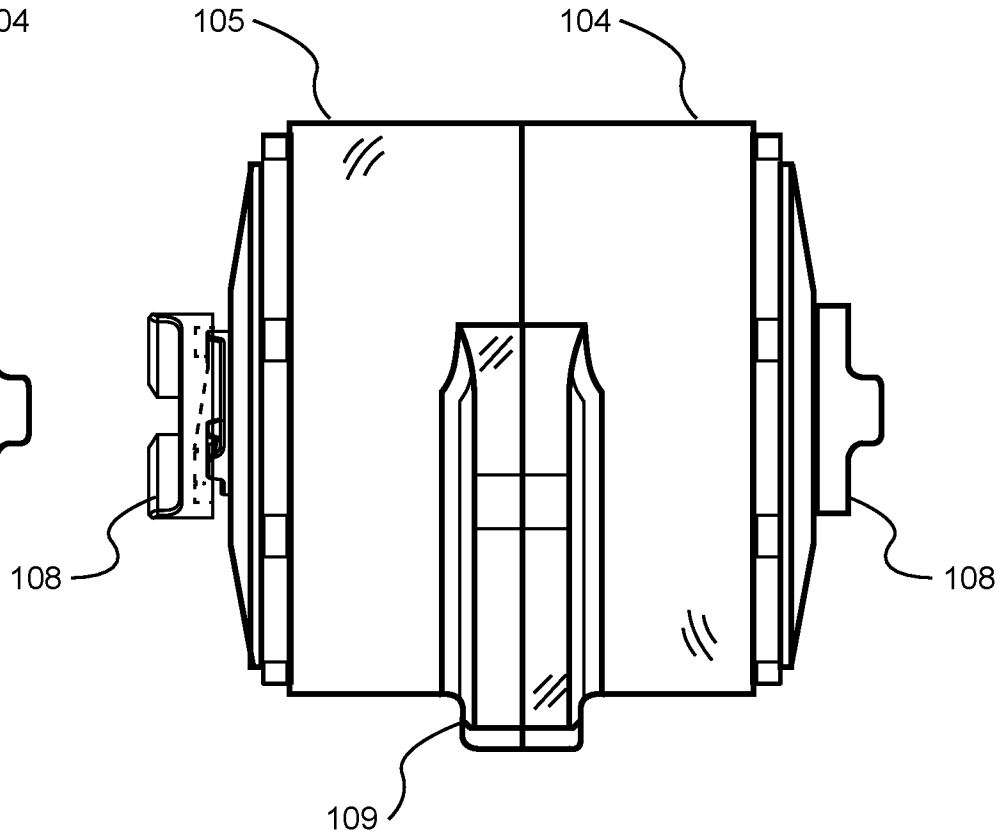
FIG. 8 is an exemplary illustration showing a bottom view of an adjustable resistance exercise machine.

FIG. 8 is an exemplary illustration showing a bottom view of an adjustable resistance exercise machine 100 comprising a left outer case 105, a right outer case 104, and a mounting block 109 used to secure the machine to a stationary object for exercising. One or both cam knobs 108 may be rotated clockwise or counterclockwise by an exerciser to increase or decrease the total number of power springs engaged for exercising.

Figure 9:
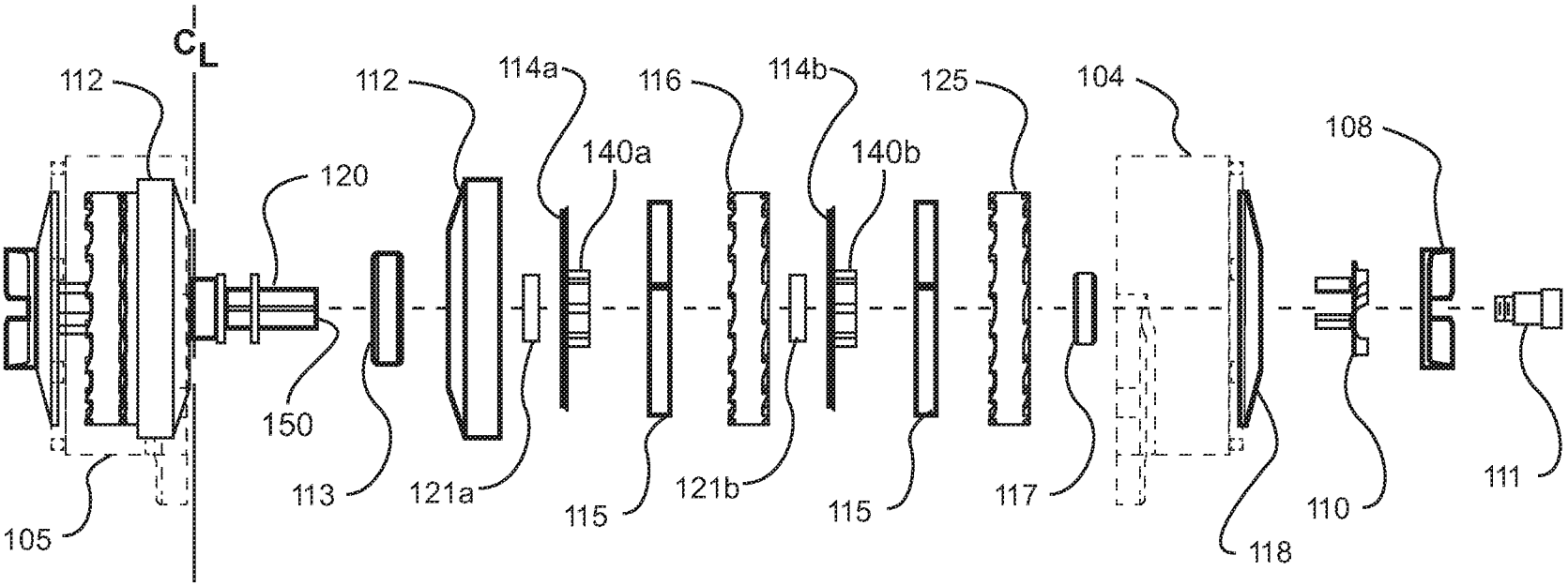
FIG. 9 is an exemplary illustration showing the side view of an exploded assembly of an adjustable resistance exercise machine.

FIG. 9 is an exemplary illustration showing the side view of an exploded assembly of an adjustable resistance exercise machine. As a means to clearly show and describe the internal components of the exercise machine, the right and left outer cases 104, 105 previously described are shown for reference by use of dashed lines. Further, the right and left halves of the machine are substantially mirror image versions on each other, with substantially all of the internal components being assembled over or onto the center shaft 120 having a center at centerline CL, and a distal end 150. Therefore, only the machine components to the right of the centerline CL are described, understanding that the same descriptions apply to the machine components on the left side of the centerline CL.

A central pulley 134 is formed by two opposed pulley flanges 112 which, when affixed closely together and mounted on a center shaft bearing 113, function as a winding spool for a pull cable 103. During exercise, one end of the cable 103 is pulled by the exerciser 300, thereby unwinding the cable 103 from the spool by applying a pull force exceeding the torque of the engaged power springs 115. The power springs 115 will retract and rewind the cable 103 about the spool when the exerciser reduces the force exerted on the pull cable.

Various components are assembled over the center shaft 120. A shaft bearing 113 is installed into a pulley flange 112; the surface facing the opposed pulley flange 112 providing for one side of a winding spool. The opposed, outer facing side of the pulley flange 112 comprises an internal gear 116 that will be shown and fully described below.

A first compression spacer 121*a* is installed between the pulley flange 112 and a first cassette assembly, the cassette assembly being comprised of a first spring retainer 114*a*, a power spring 115, and a first driven gear 116. The first spring retainer 114*a* also has a hub 140*a*.

A second compression spacer 121*b* is installed between the first cassette assembly and a second cassette assembly, the second cassette assembly being comprised of a second spring retainer 114*b*, which also has a hub 140*b*, power spring 115, and a second driven gear 125.

A cam pressure ring 117 is installed over one opposed end of the shaft 120, the pressure ring 117 providing keyways aligning with the keys on the cam follower 110. A cam knob 108, cam follower 110 and cam pressure ring 117 are all secured to each distal end 150 of the shaft 120 by means of a knob bolt 111. A cover plate 118 may function as a dust shield and a cosmetically pleasing exterior for the machine 100.

Figure 10:
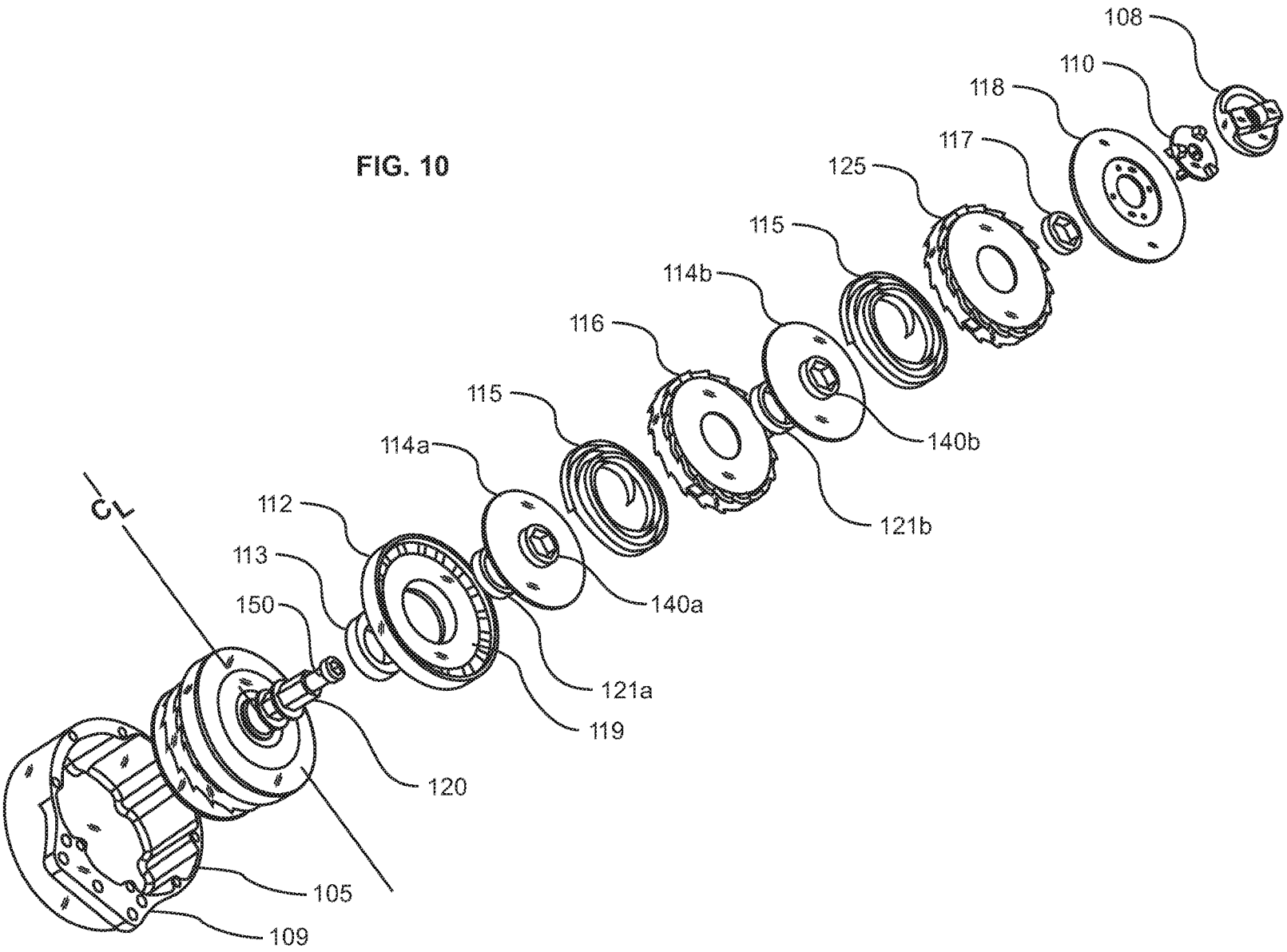
FIG. 10 is an exemplary illustration showing an isometric view of an exploded assembly of an adjustable resistance exercise machine.

FIG. 10 is an exemplary illustration showing an isometric view of an exploded assembly of an adjustable resistance exercise machine 100 in accordance with an example embodiment. In the drawing, a left outer case 105 is shown for reference. A left of centerline CL portion of the machine 100 shown as an assembly is substantially a mirror image of the right of centerline portion of the machine 100 shown in the exploded isometric drawing. For efficiency, and to avoid duplicate description of similar components which would be burdensome, only the machine components to the right of the centerline CL are described.

Substantially all of the following described components are assembled over or onto the center shaft 120. It should be noted that the center shaft may comprise a polygonal cross section, such as hexagonal, and may remain static and non-rotational relative to the opposed outer case 105 and mounting block 109. The pulley, drive gears, driven gears and resistance cassettes described herein are all rotatable about the central axis of the static center shaft 120.

A shaft bearing 113 is installed into a right pulley flange 112 with its surface facing the opposed pulley flange 112 providing for one side of a winding spool. As can be readily seen, a drive gear 119 is positioned on the non-spool side of the pulley flange 112, the drive gear 119 comprising a plurality of radially positioned gear teeth adapted to engage with corresponding gear teeth of a first driven gear 116.

A first compression spacer 121*a* may be installed between the drive gear 119 and a first cassette assembly; the cassette assembly being comprised of a first spring retainer 114*a*, power spring 115, and a first driven gear 116. A second compression spacer 121*b* may be installed between the first cassette assembly and a second cassette assembly; the second cassette assembly being comprised of a second spring retainer 114*b*, power spring 115, and a second driven gear 125.

A cam pressure ring 117 is installed over the proximal end of the shaft 120, the pressure ring providing keyways into which a cam follower 110 is installed. A cam knob 108, cam follower 110 and cam pressure ring 117 are all secured to each distal end 150 of the shaft 120 by means of a knob bolt 111. A cover plate 118 may installed as the exterior fascia of the outer case prior to bolting the cam follower 110 and cam knob 108 in place.

Figure 11:
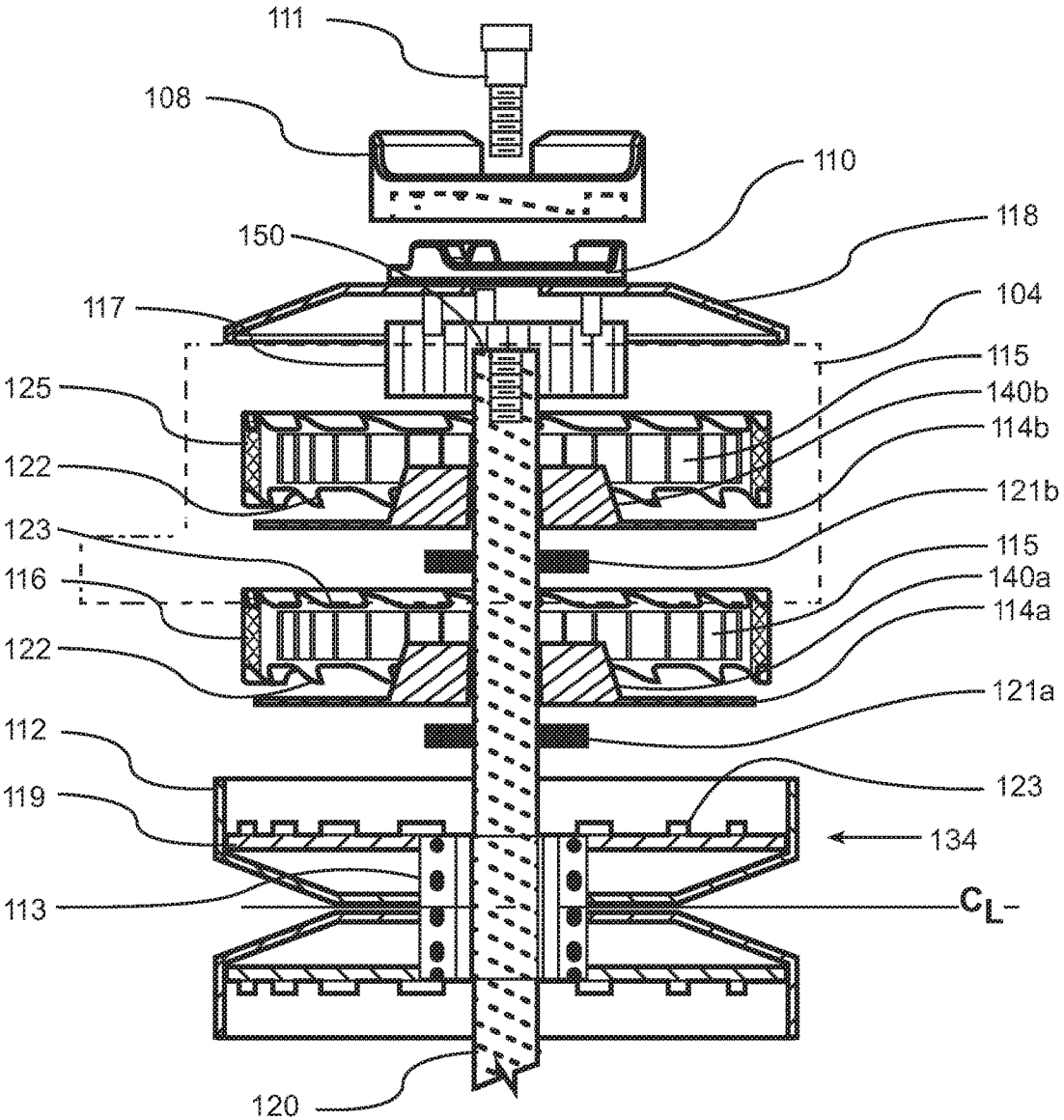
FIG. 11 is an exemplary illustration showing an exploded sectional view of a portion of an adjustable resistance exercise machine.

FIG. 11 is an exemplary illustration showing an exploded sectional view of a portion of an adjustable resistance exercise machine 100. It should be noted that all of the components shown above the horizontal centerline identified as CL represent one half of the exercise machine, and are, as previously described, substantially mirrored below the centerline. Further, to prevent obscuring the machine's 100 internal components, the right outer case 104 is shown only as dashed line indicating the case outline.

A shaft bearing 113 is installed over a shaft 120, and pressed into a right pulley flange 112. Working distally from the centerline towards the knob bolt 111, the drawing shows a drive gear 119 with a plurality of drive gear teeth 123 projecting upward towards the distal end 150 of the shaft.

A first compression spacer 121*a* is installed between the drive gear 119 and a first cassette assembly, the cassette assembly being comprised of a first spring retainer 114*a*, power spring 115, and a first driven gear 116. The preferred object of the compression spacer 121*a* is to prevent the drive gear teeth 123 from engaging the driven gear teeth 122 of the first driven gear 116 when an exerciser 300 prefers to not engage the first cassette assembly, thereby eliminating the resistance that would otherwise be provided by the power spring 115 of the first cassette assembly.

A second compression spacer 121*b* is installed over the shaft 120 between a first cassette assembly just described, and a second cassette assembly comprised of a second spring retainer 114*b*, power spring 115, and a second driven gear 125. The preferred object of the second compression spacer 121*b* is to prevent the drive gear teeth 123 of the driven gear 116 from engaging the driven gear teeth 122 of the second driven gear 125 when an exerciser 300 prefers to not engage the second cassette assembly and the spring resistance thereof.

A cam pressure ring 117 is installed over the proximal end of the shaft 120, the pressure ring providing keyways into which keys of a cam follower 110 are inserted. A cam knob 108, cam follower 110 and cam pressure ring 117 are all secured to each distal end 150 of the shaft by means of a knob bolt 111. A cover plate 118 is installed as the exterior fascia of the outer case prior to bolting the cam follower and cam knob in place.

In practice, when the cam knob 108 is rotated, thereby actuating the cam, the cam pressure ring 117 is slid over the shaft 120 a preferred dimension in a direction toward the centerline CL. The second compression ring 121*b* movement relative to the shaft 120 correspondingly pushes the second cassette assembly, the second pressure ring 117, and the first cassette assembly against the first compression ring 121*a*, thereby compressing the first compression ring 121*a* a sufficient dimension so as to allow the driven gear teeth 122 of the first driven gear 116 to engage with the drive gear teeth 123 of the drive gear 119; thereby engaging the resistance of the power spring 115 of the first cassette assembly. Continued rotation of the cam knob 108 would further compress the second compression ring 121*b* allowing the drive teeth 123 of the first driven gear 116 to engage the driven teeth 122 of the second driven gear 125, creating a total exercise resistance equal to the sum force of the power springs 115 of the first and second cassette assemblies.

Figure 12:
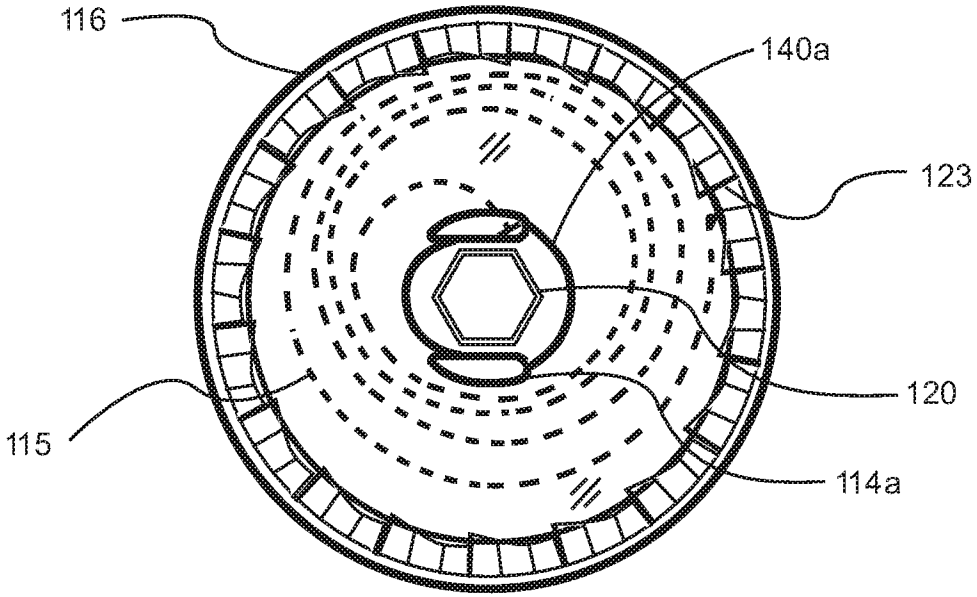
FIG. 12 is an exemplary illustration showing a side view of a driven gear and power spring of an adjustable resistance exercise machine.

FIG. 12 is an exemplary illustration showing a side view of a driven gear 116 and power spring 115 of an adjustable resistance exercise machine 100. The center, non-rotating hexagonal shaft 120 is inserted through the hexagonal thru hole of the hub 140*a* of a first spring retainer 114*a*. A first end of the power spring 115 is affixed to the hub 140*a*, and the second end of the power spring is affixed to the rotatable driven gear 116, all of which is encased within the outer case assembly formed by the right outer case 104 and left outer case 105.

In practice, when the drive gear teeth of the drive gear 119 engage with the driven gear teeth 123 of the driven gear 116, the rotation of the pulley 134 and the drive gear 119, caused by the exerciser 300 pulling, thereby unwinding the pull cable 103 from the pulley 134 with a force that exceeds the torque of the power spring 115 causes the driven gear 116 to rotate in a direction that winds the power spring to variably increase the pulling resistance.

Figure 13C:
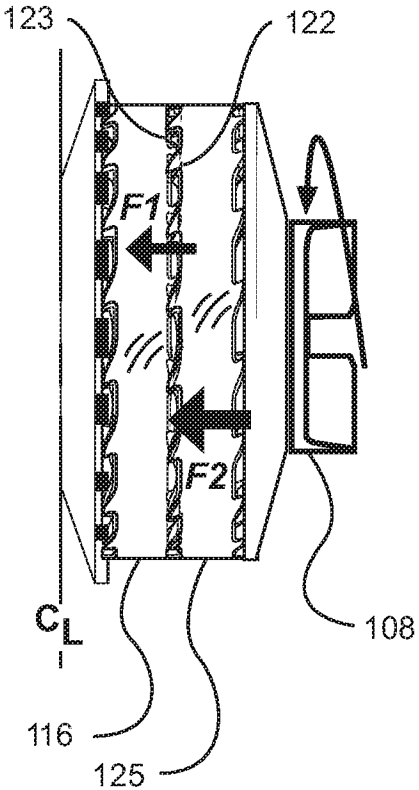
FIG. 13C is an exemplary illustration showing a side view of a plurality of engaged driven gears of an adjustable resistance exercise machine.
Figure 13B:
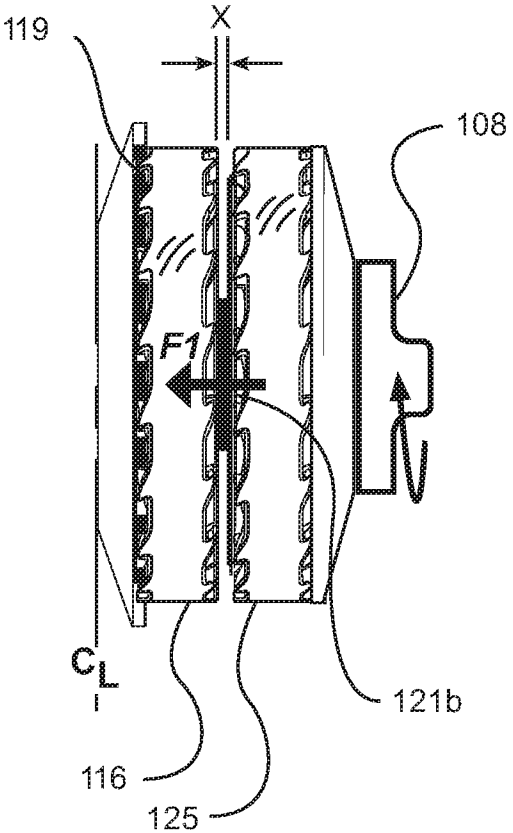
FIG. 13B is an exemplary illustration showing a side view of one engaged and one disengaged driven gear of an adjustable resistance exercise machine.
Figure 13A:
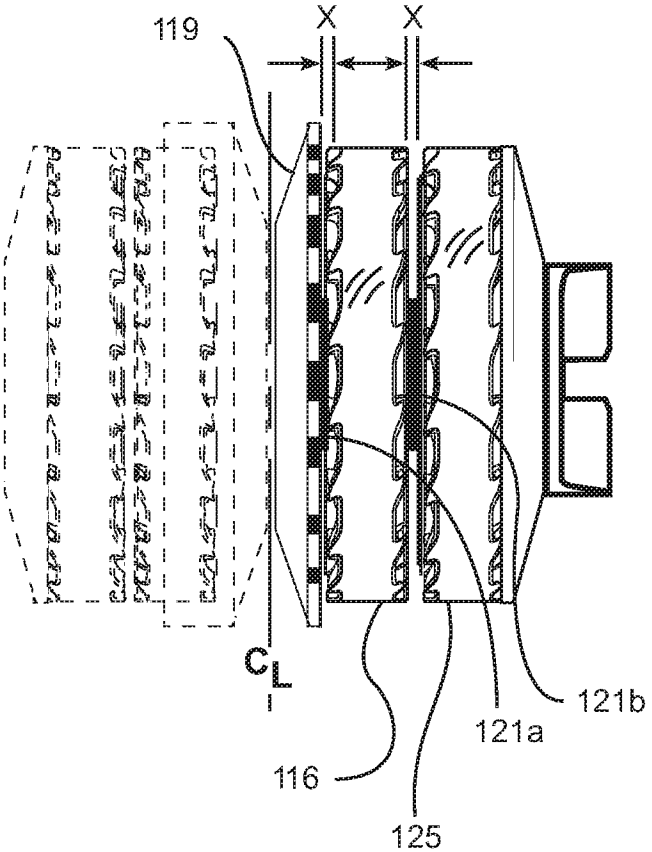
FIG. 13A is an exemplary illustration showing a side view of a plurality of disengaged driven gears of an adjustable resistance exercise machine.

FIG. 13A is an exemplary illustration showing a side view of a plurality of disengaged driven gears 116 of an adjustable resistance exercise machine 100. As previously described, the adjustable resistance exercise machine 100 comprises a center pulley 134, and a plurality of power spring cassettes movably affixed to a shaft 120 on one side of the pulley 134 formed by a pair of pulley flanges 112, and preferably an equal number of power spring cassettes, each comprised of a spring retainer 114, power spring 115, and a second driven gear 125, movably affixed to a shaft 120 on the opposed side of the pulley 134; the opposed cassettes being substantially mirror image versions of each other.

It should be noted that while the opposed cassettes are mechanically similar, the power springs 115 installed within each cassette may be of different torque ratings as one means of increasing the total number of spring force combinations for an optimum range of resistance setting choices available to an exerciser 300.

Further, in the drawing, the components on the left side of the centerline, shown as CL, being substantially the same as components on the right side of the centerline, are shown as dashed lines. For clarity, only components on the right side of the centerline are described, but the same descriptions apply to the corresponding, mirrored components on the left side of the centerline.

In FIG. 13A, the machine is shown with no exercise resistance engaged. Two compression spacers 121 are respectively shown positioned between a drive gear 119 and a first driven gear 116, and between the first driven gear 116 and a second driven gear 125. The spaces between the gears just described are shown as X to illustrate that there is no engagement of any gear teeth 122 between any of the gears 116, 119 just described. In this configuration, since there is no gear teeth engagement, rotation of the pulley 134, and correspondingly the drive gear 119, no power springs 115 will be engaged to create an exercise resistance.

FIG. 13B is an exemplary illustration showing a side view of one engaged and one disengaged driven gear 116 of an adjustable resistance exercise machine.

As just described, the components on the left side of the centerline, being substantially mirror image equivalents of the components on the right side of the centerline, are not shown. However, had they been shown the descriptions that follow would have been duplicated to describe the components not shown.

In the drawing, a cam knob 108 is shown in a rotated position relative to the default position in the preceding figure FIG. 13A. The rotation of the cam knob exerts a force F1 that acts sequentially against the second driven gear 125, then the second compression ring 121*b*, the first driven gear 116, and lastly, the first compression spacer 121*a* not shown because it has been compressed.

Compression of the first compression spacer 121*a* allows the gear teeth 123 of the drive gear 119 to engage the driven gear teeth 122 of the first driven gear 116, thereby engaging the power spring 115 which is affixed to the inner surface of the driven gear 116. The space X shown between the first driven gear 116 and the second driven gear 125 is maintained by the uncompressed compression spacer 121*b*.

FIG. 13C is an exemplary illustration showing a side view of a plurality of engaged driven gears 116, 125 of an adjustable resistance exercise machine 100. As just described, the components on the left side of the centerline, being substantially mirror image equivalents of the components on the right side of the centerline, are not shown. However, had they been shown the descriptions that follow would have been duplicated to describe the components not shown.

In the drawing, a cam knob 108 is shown in a position further rotated relative to the position in the preceding figure FIG. 13B. The further rotation of the cam knob 108 exerts a force F2 that acts sequentially against the second driven gear 125, then the second compression ring 121*b*, thereby compressing the second compression ring 121*b* so that the drive gear teeth 123 of the first driven gear 116 engage with the driven gear teeth 122 of the second driven gear 125. In the condition shown the force of the power spring 115 of the engaged second driven gear 125 is combined with the force of the power spring 115 of the engaged first driven gear 116, creating a cumulative exercise resistance force that exceeds the resistance force when only the force of the power spring 115 of the first driven gear 116 is engaged.

Figures 14A, 14B, 14C, 14D, 14E, 14F, 14G, 14H, 14I:
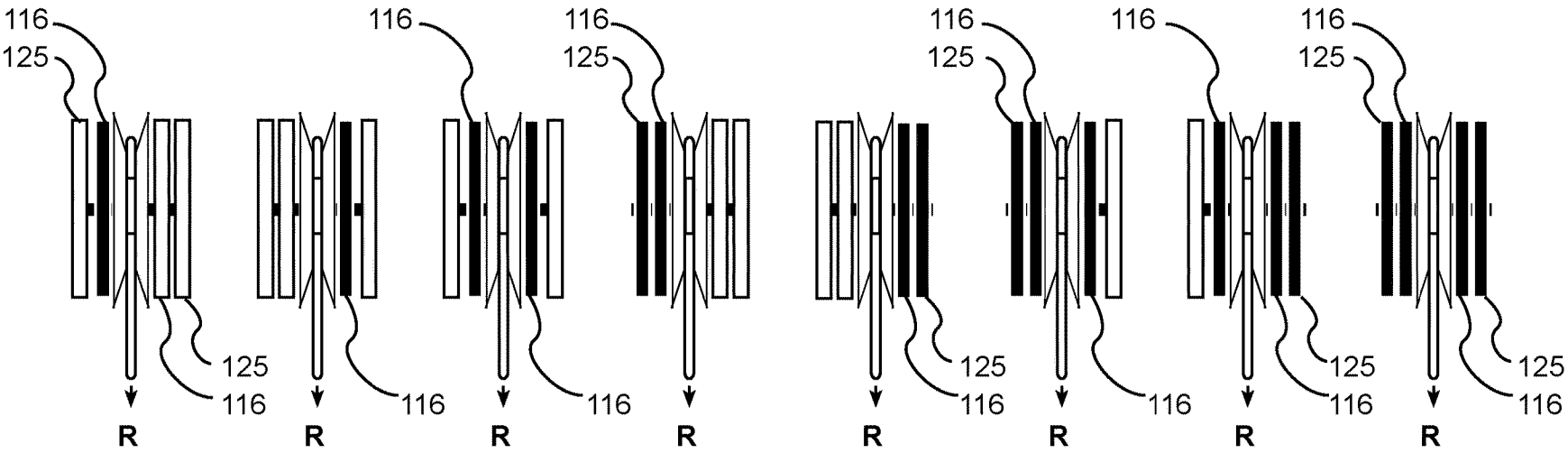
FIG. 14A is an exemplary illustration showing a table listing of spring torque ratings and cumulative torque of a machine responsive to various driven gear engagement and disengagement variations of an adjustable resistance exercise machine.
FIG. 14B is an exemplary illustration showing driven gear engagement and disengagement variations of an adjustable resistance exercise machine.
FIG. 14C is an exemplary illustration showing driven gear engagement and disengagement variations of an adjustable resistance exercise machine.
FIG. 14D is an exemplary illustration showing driven gear engagement and disengagement variations of an adjustable resistance exercise machine.
FIG. 14E is an exemplary illustration showing driven gear engagement and disengagement variations of an adjustable resistance exercise machine.
FIG. 14F is an exemplary illustration showing driven gear engagement and disengagement variations of an adjustable resistance exercise machine.
FIG. 14G is an exemplary illustration showing driven gear engagement and disengagement variations of an adjustable resistance exercise machine.
FIG. 14H is an exemplary illustration showing driven gear engagement and disengagement variations of an adjustable resistance exercise machine.
FIG. 14I is an exemplary illustration showing driven gear engagement and disengagement variations of an adjustable resistance exercise machine.

FIG. 14A is an exemplary illustration showing a table listing of spring torque ratings and cumulative torque of a machine responsive to various driven gear engagement and disengagement variations of an adjustable resistance exercise machine 100. As previously described, one variation of an adjustable resistance exercise machine 100 comprises four user-selectable resistance levels against which resistance exercising would be performed. It was also previously noted that mirror image versions of power spring cassettes assembled on opposed sides of a central pulley 134 need not incorporate internal power springs 115 of identical torque ratings.

As one example of an adjustable resistance exercise machine comprising four power springs 115, each with a different weight rating, the table 400 shows one configuration of spring weights of many alternate configurations of differently rated power springs 115, specifically listing 10 pound, 5 pound, 7 pound and 14 pound rated springs.

As was previously described, the user may select a single spring 115, or a plurality of springs 115, the plurality of springs 115 producing an exercise resistance weight that represents the cumulative resistance forces of all engaged springs 115. The total column 410 shows the total resistance force in pounds of each configuration illustrated in the following figures.

FIG. 14B is an exemplary illustration showing one driven gear engagement and disengagement variation of an adjustable resistance exercise machine 100. More specifically, an exercise machine 100 comprising a left side first driven gear 116, a left side second driven gear 125, a right side first driven gear 116, and a right side second driven gear 125. For illustrative purposes, solid filled gears are those that have been engaged for exercising, while outlined gears are those non-engaged in the exercise configuration shown. The drawing shows that only a left side first driven gear 116 is engaged, corresponding to a total pull weight of 5 pounds as shown in FIG. 14A.

FIG. 14C is an exemplary illustration showing another driven gear engagement and disengagement variation of an adjustable resistance exercise machine. More specifically, an exercise machine 100 is shown with a right side first driven gear 116 engaged, corresponding to a total pull weight of 7 pounds as shown in FIG. 14A.

FIG. 14D is an exemplary illustration showing another driven gear engagement and disengagement variation of an adjustable resistance exercise machine 100. More specifically, an exercise machine 100 is shown with a left side first and second driven gear 116, and a right side first driven gear 116 engaged, corresponding to a total pull weight of 12 pounds as shown in FIG. 14A.

FIG. 14E is an exemplary illustration showing another driven gear engagement and disengagement variation of an adjustable resistance exercise machine 100. The drawing shows a left side first driven gear 116, and a left side second driven gear 125 engaged, corresponding to a total pull weight of 15 pounds as shown in FIG. 14A.

FIG. 14F is an exemplary illustration showing another driven gear engagement and disengagement variation of an adjustable resistance exercise machine 100. The drawing shows a right side first driven gear 116, and a right side second driven gear 125 engaged, corresponding to a total pull weight of 21 pounds as shown in FIG. 14A.

FIG. 14G is an exemplary illustration showing another driven gear engagement and disengagement variation of an adjustable resistance exercise machine 100. The drawing shows a left side first driven gear 116, a left side second driven gear 125, and a right side first driven gear 116 engaged, corresponding to a total pull weight of 22 pounds as shown in FIG. 14A.

FIG. 14H is an exemplary illustration showing another driven gear engagement and disengagement variation of an adjustable resistance exercise machine 100. The drawing shows a left side first driven gear 116, a right side first driven gear 116, and a right side second driven gear 125 engaged, corresponding to a total pull weight of 26 pounds as shown in FIG. 14A.

FIG. 14I is an exemplary illustration showing another driven gear engagement and disengagement variation of an adjustable resistance exercise machine 100. The drawing shows a left side first driven gear 116, a left side second driven gear 125, a right side first driven gear 116, and a right side second driven gear 125 engaged, corresponding to a total pull weight of 36 pounds as shown in FIG. 14A.

Figure 15A:
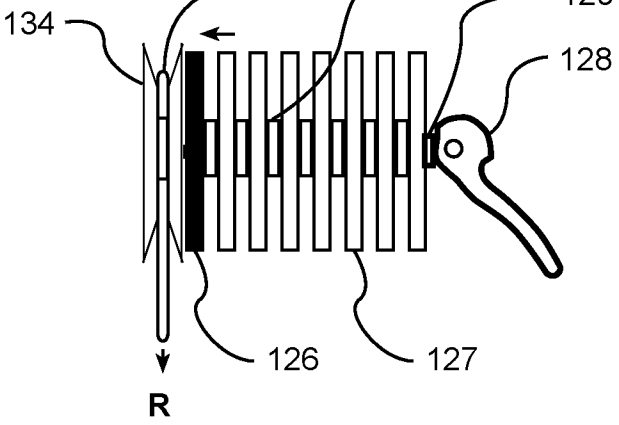
FIG. 15A is an exemplary illustration showing a side view of one engaged driven gear of a plurality of driven gears and a cam lever selector of resistance exercise machine.

FIG. 15A is an exemplary illustration showing a side view of one engaged driven gear 116 of a plurality of driven gears 116, 125 and a cam lever selector of a resistance exercise machine 100. In this exemplary embodiment, a cam lever 128 is used to engage or disengage one or more power springs 115, but previously described as an internal component to each driven gear 116, 125.

The present variation is shown with a winding pulley 134 and pull cable 103 affixed and rotatable about a proximal end of a shaft 120, a cam lever 128 movably affixed to a distal end 150 of a shaft 120, and a plurality of driven gears 116, 125 and compression spacers 121 alternately movably affixed on the shaft 120 between the winding pulley 134 and cam follower 129.

In the instant variation of an adjustable resistance exercise machine 100, each of the driven gears 116, 125 may be engaged or disengaged by an exerciser 300 by means of rotating a cam lever 128 against the cam follower 129 which has the effect of shortening the length of shaft 120 between the cam lever 128 and winding pulley 134 which is formed by the two pulley flanges 112. The rotation of the cam lever 128 thereby compresses the plurality of driven gears 116, 125 towards the winding pulley 134. The engagement driven gears begins with engagement of a first driven gear 126 proximal to the winding pulley 134, with continued rotation of the cam lever 128 sequentially engaging additional driven gears 116, 125 by successively compressing the compression spacer 121 closest to an already engaged driven gear 126, thereby engaging the next disengaged driven gear 127 proximal to the compression ring 121 just compressed.

The engaged driven gear 126 may be engaged by the interlocking of drive teeth 112 of an engaged driven gear 126 with the driven teeth 122 of the adjacent driven gear 116, 125 as previously described in FIG. 13A-13C. A notable difference between the cam of the just referenced figure and the cam of the instant variation is that the cam lever 128 of the instant variation provides for substantially increased distance of travel of the cam follower 110 relative to the shaft 120, thereby allowing the sequential engagement of an increased number of driven gears 116, 125.

Figure 15B:
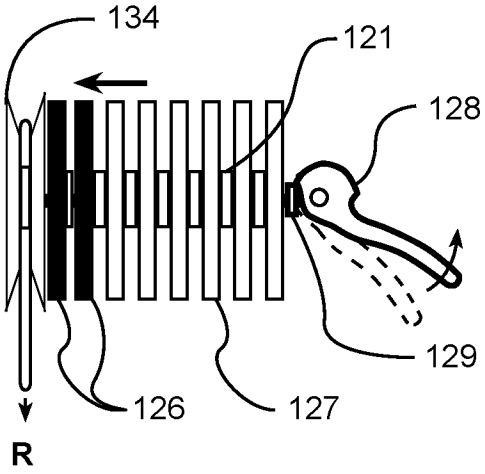
FIG. 15B is an exemplary illustration showing a side view of a plurality of engaged driven gears and a plurality of disengaged driven gears and a cam lever selector of resistance machine.

FIG. 15B is an exemplary illustration showing a side view of a plurality of engaged driven gears 126 and a plurality of disengaged driven gears 127 and a cam lever 128 selector of a resistance machine 100. More specifically, when compared to the position of the cam lever 128 as just described FIG. 15A, shown as a dotted line that indicates the previous lever position, it can be immediately seen that the cam lever 128 in the drawing is rotated in the direction of the arrow, further compressing the cam follower 129 in the direction toward the winding pulley 134.

In the present position, the compression spacer between the two engaged driven gears 126 proximal to the winding pulley 134, having been compressed in the preferred sequence relative to other non-compressed spacers 121, provides for the engagement of the gear teeth 122 of the first and second engaged driven gears 126 as previously described.

Figure 15C:
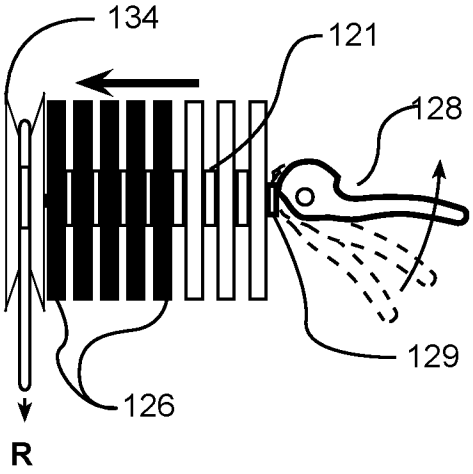
FIG. 15C is an exemplary illustration showing a side view of a variation of a plurality of engaged driven gears and a plurality of disengaged driven gears and a cam lever selector of resistance machine.

FIG. 15C is an exemplary illustration showing a side view of a variation of a plurality of engaged driven gears 126 and a plurality of disengaged driven gears 127 and a cam lever 128 selector of the resistance exercise machine 100. As shown, the cam lever 128 is rotated upwardly in the direction of the arrow beyond the previously described positions; both of which are shown as dotted lines, further compressing the cam follower 129 against the alternating stack of driven gears 126 and compression spacers 121 towards the winding pulley 134. As can be readily seen, an increased number of driven gears 126, having now been engaged, cumulatively apply an increased exercise resistance against the winding pulley 134, thereby increasing the exercise force required to pull the pull cable 103 from the pulley 134.

It should be noted that the body or work related to cams is immense, and any of the well known cam configurations may be used to compress one or more compression spacers 121 to allow engagement of one driven gear with an adjacent driven gear.

Further, the manner of compression is not meant to be limiting, and other methods known to those skilled in the art may be used to reposition the follower 129 in a direction toward or away the winding pulley 134, thereby engaging or disengaging one or more driven gears 116, 125 without deviating from the present invention, one example of such method being a common nut that may be rotated about a threaded end of the non-rotating shaft 120.

Figure 16B:
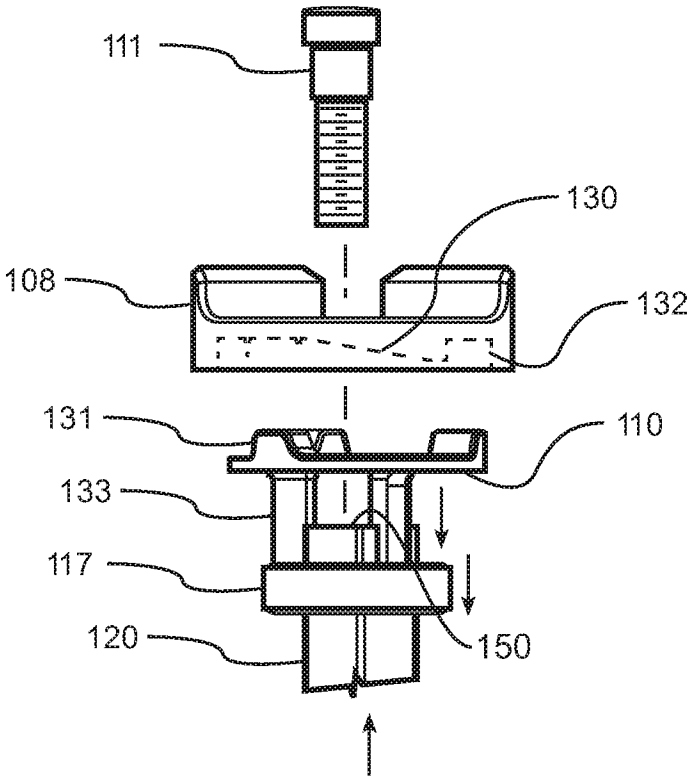
FIG. 16B is an exemplary illustration showing a side view of a cam knob assembly.
Figure 16A:
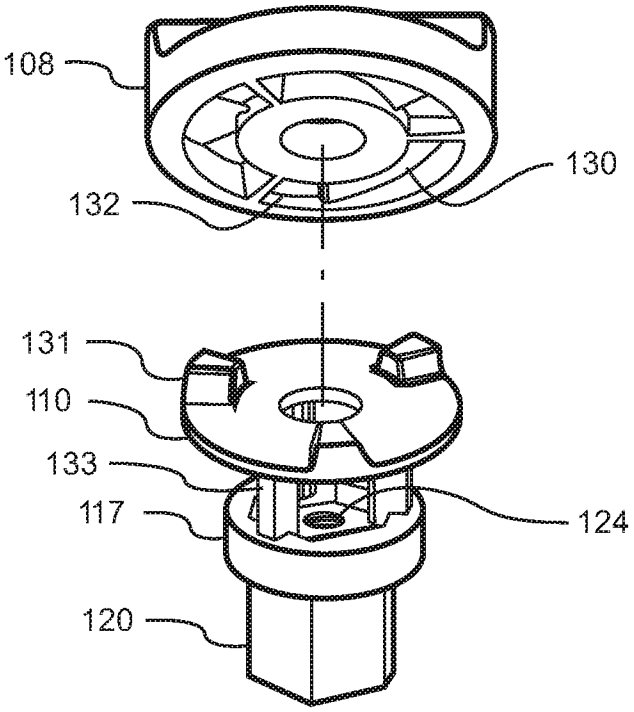
FIG. 16A is an exemplary illustration showing a perspective view of a cam knob assembly.

FIG. 16A is an exemplary illustration showing a perspective view of a cam knob assembly. As previously described, a shaft 120 extends substantially the internal width of the adjustable resistance exercise machine 100. A cam pressure ring 117 with an open hexagonal center hole is fitted over the hexagonal center shaft 120 to prevent rotation of the pressure ring 117 relative to the shaft 120. The pressure ring 117 is slidable along the longitudinal axis of the shaft 120 in response to the action of a cam knob 108. The cam pressure ring 117 comprises a plurality of slotted keyways into which a plurality of follower keys 133 is fitted; the follower keys 113 being integral with the cam follower 110. Further, a plurality of follower lobes 131 are integral with the cam follower 110, the lobes 131 positioned on the opposed upper side of the follower 110 relative to the follower keys 113 projecting downwardly on the lower side of the follower 110.

A cam knob 108 is fitted over the cam follower 110, aligning the plurality of cam ramps 130 on the underside of the cam knob 108 with the plurality of follower lobes 131 on the upper side of the follower 110. A recess on the underside of the cam knob 108, adjacent to each of the plurality of cam ramps 130 serves as a lobe lock 132, the recess being substantially the same interior dimensions as the outer dimensions of the follower lobes 131. When the follower lobes 131 are positioned within the lobe locks 108 just described, the knob 108 is prevented from accidentally reversing direction so as to unintentionally allow the cam ramps 130 to slide off of the follower lobes 131.

FIG. 16B is an exemplary illustration showing a side view of a cam knob assembly comprising a shaft 120 partially shown, distal end 150 of shaft 120, a cam pressure ring 117 with an interior hole substantially the same geometry as the outer geometry of the shaft 120, thereby allowing the ring 117 to slide longitudinally on the shaft 120, a cam follower 110 with a plurality of downward projecting follower keys 133 that fit within corresponding keyways on the interior of the pressure ring 117, and a plurality of upward projecting follower lobes 131.

A cam knob 108 is shown with certain interior features drawn with a dashed line, specifically a cam ramp 130 portion of the underside of the knob 108; the plurality of ramps 130 slidable over the upper surfaces of a plurality of follower lobes 131, and a lob lock 132; the plurality of lobe locks 132 positioned on the underside of the cam knob 108 so that they align with the upper surfaces of a plurality of follower lobes 131. A knob bolt 111 is inserted through a center hole of the cam knob 108, the center hole of the cam follower 110, and threaded into the internal threads in the shaft center, thereby securing the components just described to one end of a shaft 120.

Figure 16C:
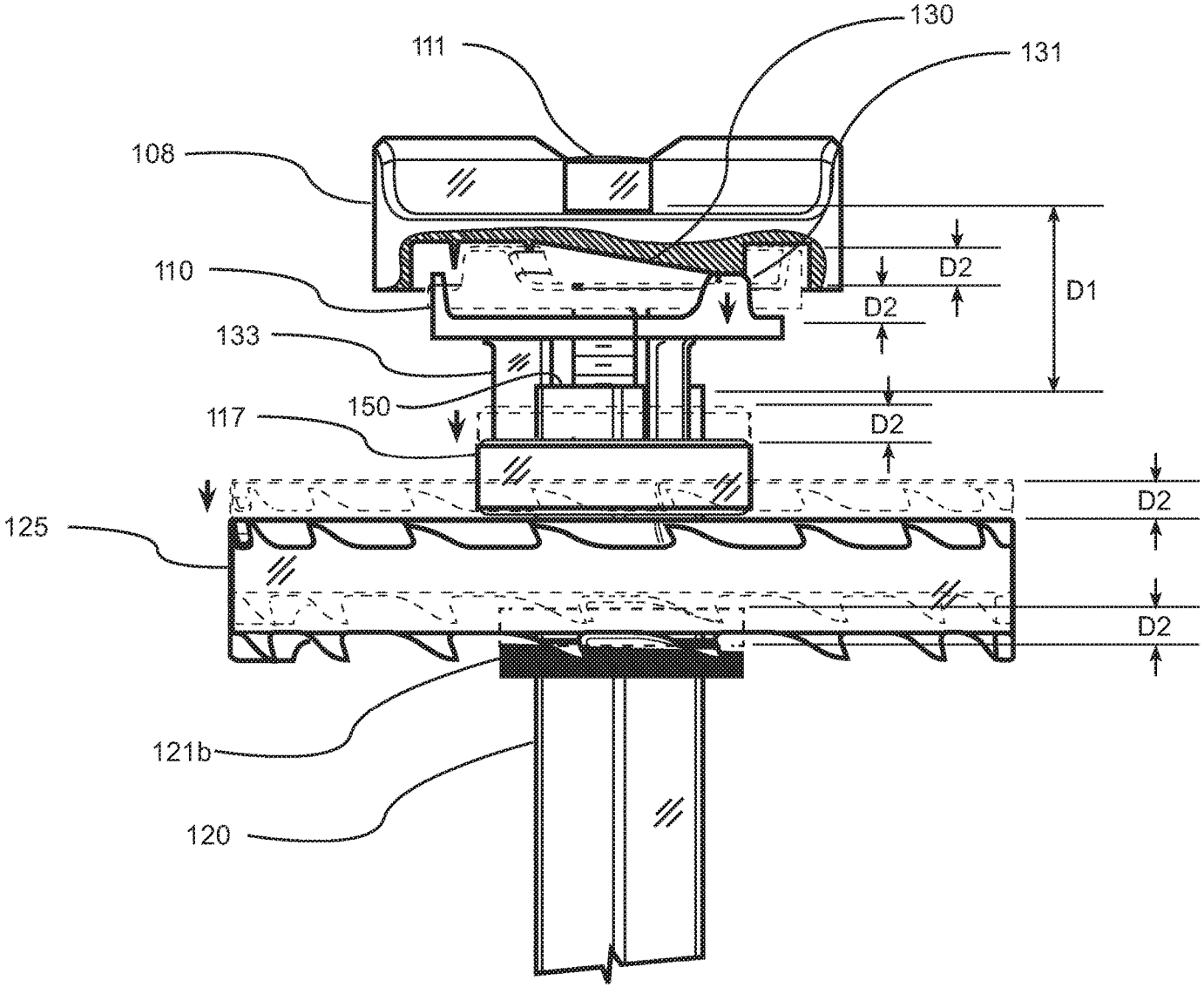
FIG. 16C is an exemplary illustration showing a side view of an actuated cam knob assembly.

FIG. 16C is an exemplary illustration showing a side view of an actuated cam knob assembly. In the drawing, a cam follower 110, cam pressure ring 117, second driven gear 125, and compression spacer 121 are shown as solid line components, with a dashed line of each component indicating the position of the respective components prior to actuation of the cam knob 108.

As previously described, a knob bolt 111 secures the cam knob 108 and cam follower 110 to an internally threaded portion at the distal end 150 of each opposed end of the shaft 120 at a preferred fixed distance, referenced in the drawing as distance D1. Only a portion of the shaft is shown for clarity, but the opposed end of the shaft 120 and the assembled components thereon substantially mirror the components shown in the drawing. Further, the cam knob 108 is shown with a near portion cut away to reveal the operational cam details on the underside of the knob 108.

In practice, an exerciser 300 preferring to engage at least one driven gear 125, and correspondingly the power spring 115 affixed therein, a cam knob 108 is rotated about the knob bolt 111, causing a plurality of cam ramps 130 to rotatably slide upon the upper surface of a plurality of follower lobes 131, thereby pushing the cam follower 110 downward towards the distal end 150 of the shaft 120 a distance substantially equal to the dimension between the top surface of the follower 110 and the top surface of the follower lobe 131, the dimension shown in the drawing as D2. Therefore, when the cam knob 108 is fully rotated, the cam follower 110 is displaced a dimension of D2.

As the cam follower 110 is repositioned towards the distal end 150 of the shaft, the plurality of follower keys 133, and correspondingly the cam pressure ring 117 are similarly repositioned an equal distance D2, the pressure ring thereby exerting a downward pressure on the second driven gear 125. In response to the downward pressure and displacement of the second driven gear 125 a second compression spacer 121*b* is compressed a substantially equal distance of D2, thereby allowing the driven teeth 122 of the second driven gear 125 to engage the drive teeth 123 of an adjacent driven gear 116.

Those skilled in the art will appreciate that the action of the cam knob 108 as just described has the effect of shortening the length of the shaft 120 between the pressure ring 117 and pulley flange 112, and in so doing, compresses the compression spacers 121*a* and 121*b* a preferred distance that allows a driven gear 116, 125 to engage with the drive gear 119, thereby creating the exercise resistance on the pull cable 103 used by the exerciser 300.

Further, it can be readily understood that various heights of follower lobes 131 may be used as a means to reposition the components relative to the shaft end one or more dimensions that are larger or smaller than the D2 dimension used in the drawing for illustrative purposes. The engagement of each follower lobe 131 of a height different from the D2 dimension will thereby engage more, or fewer driven gears 116, 125, providing for an exerciser 300 to selectively engage one, or more than one driven gear 116, 125 relative to the number of degrees the exerciser 300 rotates the cam knob 108.

Figure 17A:
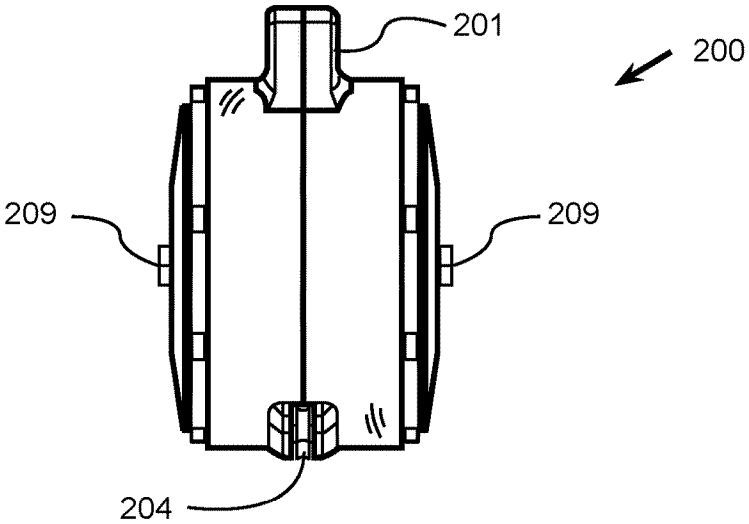
FIG. 17A is an exemplary illustration showing a top view of a variable resistance exercise machine.

FIG. 17A is an exemplary illustration showing a top view of a variable resistance exercise machine 200. A cable guide pulley 204 is shown at substantially the front of the machine, and a mounting block 201 is shown substantially at the back of the machine. The mounting block 201 is preferably used to secure the machine 200 to a stable structure, and the cable guide pulley 204 feature is preferably used to guide a pull cable 103 as it is withdrawn from the machine 100 by an exerciser 300, and similarly to guide the retraction of the pull cable 103 back into the machine 100 in response to the force of the unwinding power springs 115 as described herein. A shaft bolt 209 is shown in substantially the center of the machine 100, the bearings 113 of the rotatably operable internal components of the machine 100 being installed onto the shaft bolt 209.

Figure 17B:
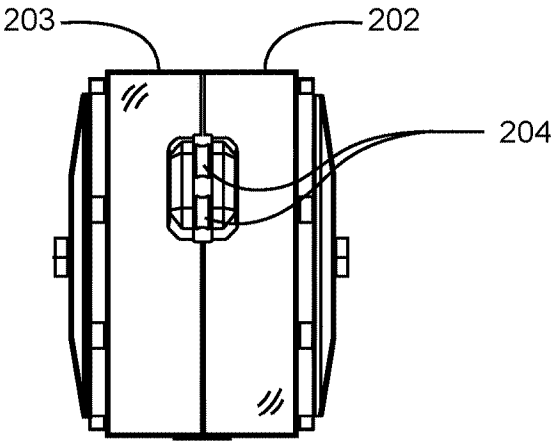
FIG. 17B is an exemplary illustration showing a front view of a variable resistance exercise machine.

FIG. 17B is an exemplary illustration showing a front view of a variable resistance exercise machine 200. The machine 200 exterior is comprised of a right outer case 202 and a left outer case 203, and a pull cable guide way created by a pair of cable guide pulleys 204 with the edges of the outer diameter of the pulleys 204 spaced apart a preferred distance that will allow for the passing of a pull cable 103 between the pulleys 204; the guide pulleys 204 thereby allowing low friction contact between the outer case 202, 203 and the pull cable 103. The use of guide pulleys 204 reduces wear on both the outer sheath of the pull cable 103, as well as the edges of the outer case 202, 203, thereby extending the useful life of the exercise machine 100.

Figure 17C:
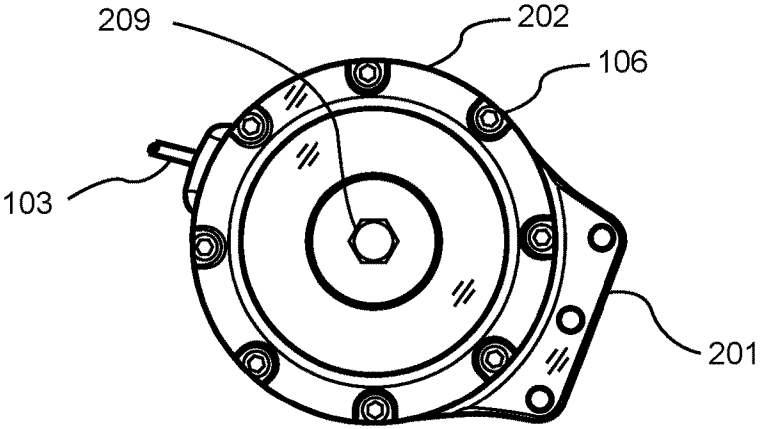
FIG. 17C is an exemplary illustration showing a side view of a variable resistance exercise machine.

FIG. 17C is an exemplary illustration showing a side view of a variable resistance exercise machine 100. As shown, a right outer case 202 is attached to a left outer case 203 by means of a plurality of bolts 106. A pull cable 103 is shown extending outward through the cable guide way, and a mounting block 201 is shown with a plurality of thru holes used to secure the variable resistance exercise machine 100 in a stationary position for use during exercising. A shaft bolt 209 is shown in substantially the center of the machine 100, the bearings 113 of the rotatably operable internal components of the machine 100 being installed onto the shaft bolt 209.

It should be noted that the words top, front, side and back as just described are used to describe the variable resistance exercise machine 100 mounted in the configuration shown relative to a horizontal plane. However, the mounting position is not meant to be limiting, and the machine 100 may be mounted on any non-horizontal plane for use during an exercise.

Figure 18:
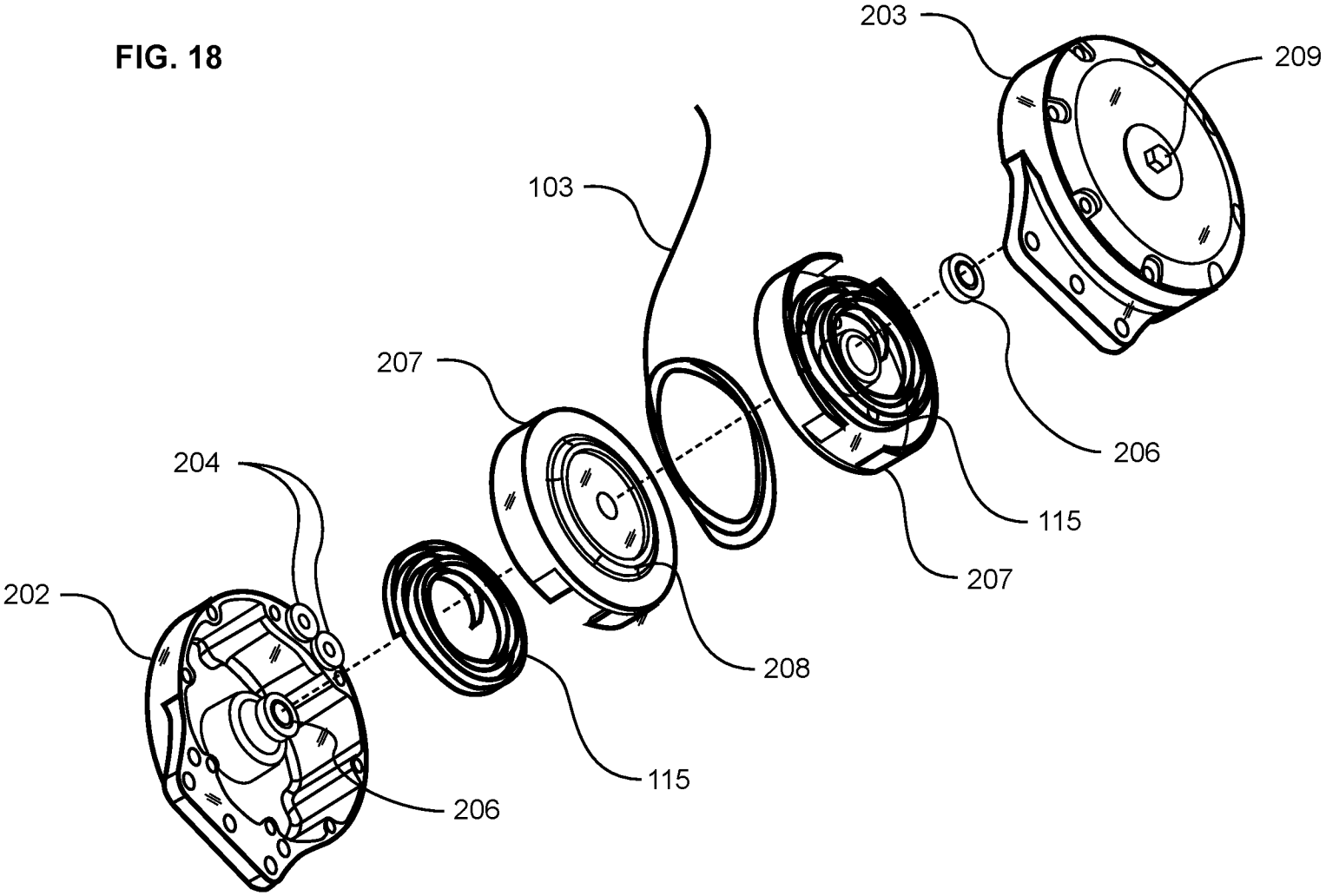
FIG. 18 is an exemplary illustration showing an exploded isometric view of a variable resistance exercise machine.

FIG. 18 is an exemplary illustration showing an exploded isometric view of a variable resistance exercise machine 100, the variable resistance determined by the power spring force of power springs 115 attached to and contained within a plurality of pulley flanges 207.

A right outer case 202 is shown with two cable guide pulleys 204 rotatably mounted on guide pins, the cable guide pulleys 204 being retained between the left outer case 203 and right outer case 202 after the outer cases 202, 203 are assembled together. Two cassettes are shown as substantially mirror image versions of one another, each cassette comprising a pulley flange 207, a bearing 206 installed within the center hub of the pulley flange 207, and a power spring 115; with one end of the power spring 115 affixed to the respective outer case, and the opposed end of the power spring 115 affixed to the pulley flange 207.

As can be seen, the assembly of one pulley flange 207 to the opposed pulley flange 207 forms a complete pulley 134; with a raised detail on each flange 207 forming one half of a winding groove 208 upon which a pull cable 103 is secured and wound. A shaft bolt 209 extends substantially through and beyond both outer cases 202, 203 providing for traditional washer, nut and bolt hardware to be affixed to, thereby securing the bolt 209 as the canter shaft 120 about which the pulley flanges 207 rotate.

During assembly, one end of the pull cable 103 is affixed to the pulley flanges 207; the remainder of the pull cable 103 being wound about the winding groove 208 with the unsecured end of the pull cable 103 being passed between the cable guide pulleys 204. Although not shown, the unsecured end of the pull cable 103 is terminated with various components that do not allow the pull cable 103 to be fully retracted within the exercise machine 100, and which further allow various handle accessories to be attached that an exerciser 300 may grasp during exercising.

Figures 19A, 19B:
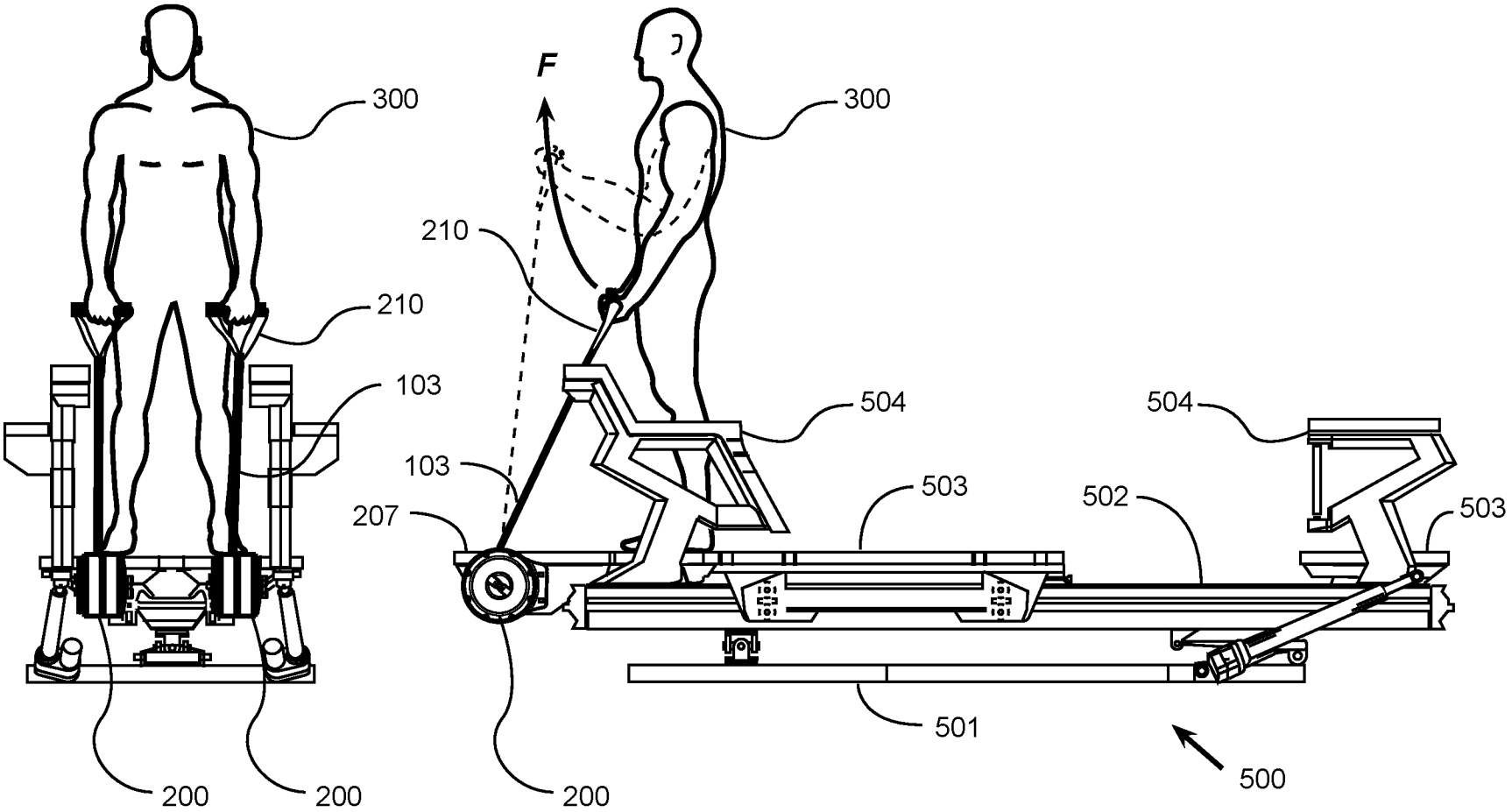
FIG. 19A is an exemplary illustration showing a front view of a plurality of variable resistance exercise machines affixed to a gym machine.
FIG. 19B is an exemplary illustration showing a side view of an exerciser using variable resistance exercise machines affixed to a gym machine.

FIG. 19A is an exemplary illustration showing a front view of a plurality of variable resistance exercise machines affixed to a gym machine. In the drawing, an exerciser 300 is standing on a gym machine to which two variable resistance exercise machines 200 have been affixed for exercising, each machine 200 comprising at least a pull cable 103 extending from a winding pulley 134, but which has been previously described, and a strap pull handle 201 which an exerciser 300 may grasp with a hand for exercising.

FIG. 19B is an exemplary illustration showing a side view of an exerciser 300 using variable resistance exercise machines affixed to a gym machine 500 generally comprising a lower structure 501 and an upper structure 502 to which a plurality of exercise platforms 503 and support handles 504 have been affixed.

A variable resistance exercise machine 200 is shown having been securedly affixed to an upper structure and exercise platform 502, 503 to allow for an exerciser to pull, and therefore extend a pull cable 103 against the resistance induced by the exercise machine 200.

In practice, an exerciser 300, grasping the strap pull handle 210, flexes the appropriate muscles necessary to move the handle 210 substantially in an arc with a pull force F. In the drawing, a dashed outline of the exerciser's arm is shown to illustrate the position of the hand and strap pull handle at the peak of the work cycle. Although the drawing shows a variable resistance exercise machine, an adjustable resistance exercise machine as previously described may be used in one variation.

It should be noted that a variable resistance exercise machine 100 as disclosed herein may incorporate identical resistance power springs 115 within each of the opposed pulley flanges 112, or may incorporate springs 115 of two different resistance ratings. Further, any combination of springs 115 of any weight may be assembled into the exercise machine 110; the total torque induced resistance rating of the machine 100 therefore being the sum of the two power springs 115 used in the machine.

As can now be appreciated by those skilled in the art, the various embodiments of present invention as described provide for a new and novel exercise machine that is easily transportable, and provides an exerciser with a substantially large number of resistance options against which to exercise.

Although specific embodiments have been illustrated and described herein, it will be appreciated by those of ordinary skill in the art that a wide variety of alternate and/or equivalent implementations may be substituted for the specific embodiments shown and described without departing from the scope of the present disclosure. This application is intended to cover any adaptations or variations of the embodiments discussed herein.

What is claimed is:

1. An adjustable resistance exercise machine, comprising:

a center shaft comprising a center and a distal end;

a drive gear rotatably mounted on the center shaft, the drive gear comprising drive gear teeth;

a first spring retainer positioned on the center shaft by a hub of the first spring retainer;

a first power spring having a first end and a second end, wherein the first end is rotationally held by the hub of the first spring retainer;

a first driven gear rotatably positioned over the center shaft, wherein the second end of the first power spring is attached to the first driven gear, the first driven gear comprising a first set of teeth that selectively engage with the drive gear teeth so that the first driven gear rotates when the drive gear rotates;

a first compression spacer positioned between the center of the center shaft and a cam pressure ring to hold the first set of teeth out of engagement with the drive gear teeth; and a cam knob on the distal end of the center shaft, the cam knob comprising a cam ramp, wherein the cam ramp is positioned to apply a force to the cam pressure ring toward the center of the center shaft to compress the first compression spacer;

wherein the first teeth of the driven gear engage with the drive gear teeth when the first compression spacer is compressed, and wherein rotation of the drive gear is resisted by the first power spring.

2. The adjustable resistance exercise machine of claim 1, further comprising a central pulley rotationally mounted on the center shaft proximate the center of the center shaft;

wherein the central pulley rotates about the center shaft when a pull cable wound around the central pulley is pulled.

3. The adjustable resistance exercise machine of claim 2, wherein the drive gear is secured on an inside of the central pulley.

4. The adjustable resistance exercise machine of claim 1, wherein a central portion of the center shaft is polygonal.

5. The adjustable resistance exercise machine of claim 1, wherein a central portion of the center shaft is hexagonal.

6. The adjustable resistance exercise machine of claim 5, wherein the hub of the first spring retainer comprises a hexagonal central opening through which the center shaft extends.

7. The adjustable resistance exercise machine of claim 1, further comprising a cam follower positioned between the cam ramp and the cam pressure ring to transfer force from the cam ramp to the cam pressure ring.

8. The adjustable resistance exercise machine of claim 7, wherein the cam knob further comprises a rotating cam knob.

9. The adjustable resistance exercise machine of claim 1, wherein the cam knob further comprises a rotating cam knob.

10. The adjustable resistance exercise machine of claim 1, wherein the first driven gear comprises second set of teeth on a side opposite the first set of teeth, further comprising:

a second spring retainer positioned on the center shaft by a hub of the second spring retainer, between the first driven gear and the distal end of the center shaft;

a second power spring having a first end and a second end, wherein the first end of the second power spring is rotationally held by the hub of the second spring retainer;

a second driven gear rotatably positioned over the center shaft, wherein the second end of the second power spring is attached to the second driven gear, the second driven gear comprising a third set of teeth that selectively engage with the second set of teeth so that the second driven gear rotates when the first driven gear rotates;

a second compression spacer positioned between the first driven gear and the cam pressure ring to hold the third set of teeth out of engagement with the second set of teeth; and wherein the cam pressure ring is displaceable by the cam ramp to compress the second compression spacer;

wherein the third set of teeth engage with the second set of teeth when the second compression spacer is compressed, and wherein rotation of the drive gear is resisted by the second power spring.

11. The adjustable resistance exercise machine of claim 10, further comprising a central pulley rotationally mounted on the center shaft proximate a center of the center shaft;

wherein the central pulley rotates about the center shaft when a pull cable wound around the central pulley is pulled.

12. The adjustable resistance exercise machine of claim 11, wherein the drive gear is secured on an inside of the central pulley.

13. The adjustable resistance exercise machine of claim 10, wherein a central portion of the center shaft is polygonal.

14. The adjustable resistance exercise machine of claim 10, wherein a central portion of the center shaft is hexagonal.

15. The adjustable resistance exercise machine of claim 14, wherein the hub of the first spring retainer comprises a hexagonal central opening through which the center shaft extends.

16. The adjustable resistance exercise machine of claim 10, further comprising a cam follower positioned between the cam lobe and the cam pressure ring to transfer force from the cam lobe to the cam pressure ring.

17. The adjustable resistance exercise machine of claim 16, wherein the cam mechanism further comprises a rotating cam knob.

18. The adjustable resistance exercise machine of claim 10, wherein the cam mechanism further comprises a rotating cam knob.

19. The adjustable resistance exercise machine of claim 10, wherein the first power spring provides a first resistance to the drive gear and the second power spring provides a second resistance to the drive gear, the first resistance and the second resistance being different.

20. The adjustable resistance exercise machine of claim 1, further comprising:

a second drive gear rotatably mounted on the center shaft, spaced apart from the first drive gear and positioned between a center of the center shaft and a second distal end of the center shaft, the first drive gear and the second drive gear being substantially symmetrically mounted on the center shaft with respect to the center, the second drive gear comprising second drive gear teeth;

a second spring retainer positioned on the center shaft by a hub of the second spring retainer;

a second power spring having a first end and a second end, wherein the first end of the second power spring is rotationally held by the hub of the second spring retainer;

a second driven gear rotatably positioned over the center shaft, wherein the second end of the second power spring is attached to the second driven gear, the second driven gear comprising a second set of teeth that selectively engage with the second drive gear teeth so that the second driven gear rotates when the second drive gear rotates, the second driven gear being substantially symmetrically mounted opposite the first driven gear on the center shaft with respect to the center;

a second compression spacer positioned between the hub of the center shaft and a second cam pressure ring to hold the second set of teeth out of engagement with the second drive gear teeth; and a second cam knob on the second distal end of the center shaft, the second cam knob comprising a second cam ramp, wherein the second cam ramp is positioned to apply a force to the second cam pressure ring toward the center of the center shaft to compress the second compression spacer;

wherein the second teeth of the second driven gear engage with the second drive gear teeth when the second compression spacer is compressed, and wherein rotation of the second drive gear is resisted by the second power spring.

* * * * *